US005969740A

United States Patent [19]

Maeda et al.

[11] Patent Number: 5,969,740

[45] Date of Patent: Oct. 19, 1999

[54] INK-JET RECORDING PROCESS, AND INK-JET RECORDING APPARATUS

[75] Inventors: Hiroyuki Maeda, Yokohama; Isao Kimura, Kawasaki; Hidemi Kubota, Komae, all of Japan

[73] Assignee: Canon Kabushiki Kaisha, Tokyo, Japan

[21] Appl. No.: 08/720,451

[22] Filed: Sep. 30, 1996

[30] Foreign Application Priority Data

Sep. 29, 1995 [JP] Japan ..... 7-275156

[51] Int. Cl.[6] ..... B41J 2/355; B41J 2/385

[52] U.S. Cl. ..... 347/101; 347/100; 347/102

[58] Field of Search ..... 347/100, 102, 347/185, 186, 187, 101; 523/160

[56] References Cited

U.S. PATENT DOCUMENTS

| | | | |
|---|---|---|---|
| 4,394,669 | 7/1983 | Ozawa et al. | 347/86 |
| 4,514,540 | 4/1985 | Peck | 524/514 |
| 4,635,078 | 1/1987 | Sakurada et al. | 347/15 |
| 5,509,140 | 4/1996 | Koitabashi et al. | 347/86 |
| 5,579,038 | 11/1996 | Kimura | 347/36 |
| 5,606,356 | 2/1997 | Noguchi et al. | 347/100 |

FOREIGN PATENT DOCUMENTS

| | | |
|---|---|---|
| 329026A1 | 8/1989 | European Pat. Off. . |
| 584509A1 | 3/1994 | European Pat. Off. . |
| 618278A2 | 10/1994 | European Pat. Off. . |
| 704504A2 | 4/1996 | European Pat. Off. . |
| 761782A1 | 3/1997 | European Pat. Off. . |
| 2-165964 | 6/1990 | Japan . |
| 2-231148 | 9/1990 | Japan . |

OTHER PUBLICATIONS

Patent Abstracts of Japan, vol. 18, No. 209 (C–1190), Apr. 13, 1994 (with respect to JP 6–9848 of Jan. 18, 1994).

Patent Abstracts of Japan, vol. 14, No. 526 (C–779), Nov. 19, 1990 (with respect to JP 2–218429 of Aug. 31, 1990).

Derwent WPI, Derwent Publications, Ltd., Class A18, AN 90–308975, XP–002053836 (with respect to JP 2–218429, Aug. 31, 1990).

*Primary Examiner*—Valerie Lund
*Assistant Examiner*—Christina Annick
*Attorney, Agent, or Firm*—Fitzpatrick, Cella, Harper & Scinto

[57] ABSTRACT

Provided is an ink-jet recording process comprising, using an ink containing a coloring matter, a liquid medium and at least one thermoreversible thickening polymer, ejecting the ink from orifices of a recording head onto a recording medium in accordance with recording signals to perform recording, wherein said ink is heated to various temperatures corresponding to recording image color signals to vary an optical density or a color reproduction range of a printed matter formed on a recording medium, thereby performing recording.

25 Claims, 8 Drawing Sheets

INK-JET RECORDING PROCESS, AND INK-JET RECORDING APPARATUS

BACKGROUND OF THE INVENTION

1. Field of the Invention

This invention relates to an ink-jet recording process making use of a water-based ink especially suited for ink-jet printers, and an ink-jet recording apparatus making use of such an ink.

2. Related Background Art

Ink-jet recording process is a process in which ejected ink droplets are formed using a recording solution such as ink by various methods and the ink droplets are adhered to a recording medium such as paper to make a record.

Ink-jet recording apparatus employing a recording process of this type enable high-speed printing at low noise and high-density recording. Moreover, the apparatus can print images on plain paper without requiring any processing such as developing and fixing, and hence the apparatus itself can be made down sized. Also, such apparatus can be manufactured with good productivity when mass-produced and can be manufactured at a low production cost.

In particular, On-Demand type ink-jet recording apparatus can readily form color images and make the apparatus itself small-sized, simple and inexpensive, and therefore this application is considered promising.

However, with the spread of color type ink-jet recording apparatus, it has become desired to improve color representation of recorded images formed on recording media. In improving color reproducibility, a color region which the recording images can form is further expanded to form intermediate tints.

As measures conventionally taken for meeting such a requirement, a method of providing density gradation of colored pixels is available, as proposed in Japanese Patent Application Laid-Open Nos. 2-165964, and 2-231148 and U.S. Pat. No. 4,635,078. This method includes a technique in which a shot-in quantity of ink in one pixel is varied to change a size of dot diameter so that the coverage of pixels is changed, a technique in which, while the dot diameter is unchanged, a number of dots arranged in one pixel is changed so that the coverage of pixels is changed, a technique in which one dot is shot into each pixel using plural kinds of inks having different concentrations of coloring matter components in ink so that the pixels themselves have different densities, and also a technique in which some of these technique are used in combination. Using these techniques, efforts have been made for the achievement of improvements in color reproduction by changing the density gradation of the colored pixels to increase the ability to form intermediate tints.

However, in order to accomplish a technique for changing density gradation of colored pixels to increase the ability to form intermediate tints, it has become necessary to arrange the recording head nozzles in a higher density, to eject ink droplets from the recording head in a smaller volume and to make the recording head move on a recording medium in a greater number of times than ever. Accordingly, it has become necessary to re-design recording heads and to provide a high-speed CPU or memory for large amounts processing image information resulting in a great cost increase.

In order to accomplish a technique making use of plural kinds of inks having different concentrations of coloring matter components in ink, it has become necessary to provide recording heads in the number corresponding to the types of ink and a controller for controlling these heads, also resulting in a great cost increase.

SUMMARY OF THE INVENTION

The present invention was made taking these problems into account. Accordingly, an object of the present invention is to provide at a low cost an ink-jet recording process and a recording apparatus that can improve the ability to form intermediate tints and achieve an improvement in color reproducibility by merely adding a simple device to an ink-jet recording apparatus.

Such an object can be achieved by employing an ink-jet recording process comprising, using an ink containing a coloring matter such as a dye and a pigment, a liquid medium and at least one thermoreversible thickening polymer, ejecting the ink from orifices of a recording head onto a recording medium in accordance with recording signals to perform recording, wherein the ink is heated to a temperature corresponding to recording image color signals to vary an optical density or a color reproduction range of a printed matter formed on a recording medium, thereby performing recording; and an ink-jet recording apparatus making use of this ink-jet recording process.

According to the present invention, there is provided an ink-jet recording process comprising, using an ink containing a coloring matter such as a dye or a pigment, a liquid medium and at least one thermoreversible thickening polymer, ejecting the ink from orifices of a recording head onto a recording medium in accordance with recording signals to perform recording, wherein the ink is heated to various temperature corresponding to recording image color signals to vary an optical density or a color reproduction range of a formed print, thereby performing recording.

According to the present invention, there is also provided an ink-jet recording apparatus comprising a means for, using an ink containing a coloring matter such as a dye or a pigment, a liquid medium and at least one thermoreversible thickening polymer, ejecting the ink from orifices of a recording head onto a recording medium in accordance with recording signals to perform recording, wherein the ink is heated to various temperatures corresponding to recording image color signals to vary an optical density or a color reproduction range of a printed matter formed on a recording medium, thereby performing recording.

DETAILED DESCRIPTION OF THE PREFERRED EMBODIMENTS

Figure 1:
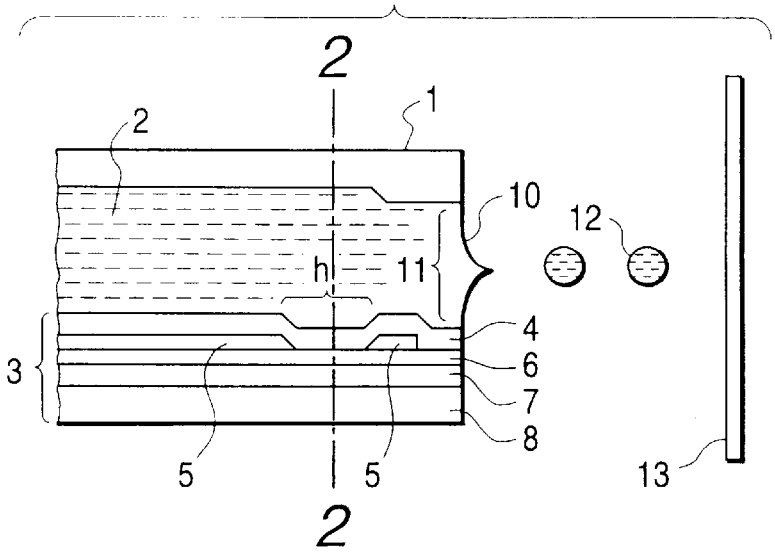
FIG. 1 is a longitudinal cross section of a head assembly of an ink-jet recording apparatus.

The present invention will be described below in detail.

The present inventors have found a process to use an ink containing a thermoreversible thickening polymer which gels thermoreversibly upon sensing a temperature at its transition temperature or above, in which an ink droplet is ejected from an ink-jet recording head after the ink has been heated at a temperature not lower than the transition temperature of the ink immediately before the ink is ejected, and the ink droplet is changed in state while it is ejected, e.g., to partly gel, to record images on a recording medium. As a result, the diameter and form of impacted dots and the color tone and optical density of the dots themselves were changed more to greatly change the color gradation, when the images were recorded on the recording medium while changing the temperature of the heated ink than when image were recorded without heating the ink. From this finding, they have reached the present invention.

Thus, in the present invention, using the ink containing a thermoreversible thickening polymer which gels thermoreversibly upon sensing a temperature at its transition temperature or above, this ink is heated to a temperature corresponding to recording image color signals so that the form and size of impacted dots formed by the ink on the recording medium and the thickness of a colored layer formed by the coloring matter on the recording medium are changed by an elevated temperature of ink to vary an optical density or a color reproduction range, thereby performing recording. This makes it possible to provide an ink-jet recording process, and an ink-jet recording apparatus, that can improve color forming performance to achieve an improvement in color reproducibility.

The thermoreversible thickening polymer which gels thermoreversibly upon sensing temperature at its transition temperature or above is meant to be a substance to increase the viscosity of part or the whole of the ink by a water-soluble polymer molecule which is dissolved and dissociated in ink at a temperature lower than the transition temperature and causes association of polymer molecules at its transition temperature or above. The association rate of polymer molecules changes depending on temperatures, and hence the viscosity of ink at the transition temperature or above changes depending on the changes of temperature.

At the time when the ink containing these associated polymer molecules is impacted on the recording medium to form dots, the part of ink that has a high viscosity because of the associated polymer molecules remains at the surface portion of the recording medium. On the other hand, unassociated polymer molecules are dissolved in the ink and hence the ink having a low viscosity at that part permeates into the recording medium. Thus, the greater the proportion of associated polymer molecules, the more polymer molecules remain at the surface portion of the recording medium. Depending on a degree of association of polymers that changes in accordance with the change in temperature, the extent of dot diameters of an impacted ink on the recording medium can be suppressed and the coloring matter layer having a high density can be formed on the surface portion of the recording medium in a thickness corresponding to the change in temperature. In this way, the degree of association of polymers in ink remaining on the recording medium is changed in accordance with the change in temperature and the extent and thickness of the coloring matter layer at the surface portion of the recording medium are changed, whereby the improvement in optical density and color reproduction range is achieved. The degree of change in the extent and the thickness of the coloring matter layer at the surface portion of the recording medium becomes greater as the difference between the environmental temperature and the transition temperature of the thermoreversible thickening polymer which gels thermoreversibly upon sensing temperature in ink becomes greater.

The thermoreversible thickening polymer used in the present invention which gels thermoreversibly upon sensing temperature in ink may preferably have a transition temperature of from 10° C. to 100° C., and preferably from 30° C. to 85° C., in order to make the transition temperature higher than the environmental temperature (room temperature) at which the recording apparatus is usually used, and also in order to effectively cause the viscosity increase due to a temperature change, i.e., in order to make the temperature difference greater before and after the change in state. A transition temperature higher than 100° C. is not preferable because a viscosity increase may greatly occur due to an evaporation of water in the ink, making it difficult to bring out the performance of the ink containing the thermoreversible thickening polymer which gels thermoreversibly upon sensing temperature.

The present invention will be described below in greater detail by giving working embodiments.

The thermoreversible thickening polymer which gels thermoreversibly upon sensing temperature at its transition temperature or above, capable of undergoing dissociation-dissolution and association-viscosity increase at temperatures where the ink of the present invention is used will be described first. The thermoreversible thickening polymer is meant to be a polymer, the aqueous solution or the aqueous suspension of which increases in viscosity at a certain temperature (transition temperature) or higher and exhibits a reversible temperature-viscosity relationship.

A preferred example of the above thermoreversible thickening polymer used in the present invention is a water-soluble vinyl-type polymer (A) containing as a constituent unit not less than 50% by weight of a vinyl-type carboxylate (a) of an addition product of alkylene oxide with an active hydrogen compound having a nitrogen-containing ring, and the compound (a) is an acrylate or methacrylate of an addition product of 1 mol of unsubstituted or substituted morpholine with 1 to 20 mol of an ethylene oxide and/or propylene oxide.

The above active hydrogen compound having a nitrogen-containing ring includes compounds having an active hydrogen through which the nitrogen-containing ring and the alkylene oxide form an addition product, as exemplified by nitrogen-containing alicyclic compounds, e.g., those having an aziridine ring, such as aziridine and 2-methylaziridine, those having a pyrrolidine ring, such as pyrrolidine, 2-methylpyrroridine, 2-pyrrolidone and succinimide, those having a piperidine ring, such as piperidine, 2-methylpiperidine, 3,5-dimethylpiperidine, 2-ethylpiperidine, 4-piperidinopiperidine, 4-pyrrolidinopiperidine and ethyl pipecolinate, those having a piperazine ring, such as 1-methylpiperazine and 1-methyl-3-ethylpiperazine, those having a morpholine ring, such as morpholine, 2-methylmorpholine and 3,5-dimethylmorpholine, ε-caprolactum, and nitrogen-containing unsaturated cyclic compounds such as 3-pyrroline, 2,5-dimethyl-3-pyrroline, 2-hydroxypyridine, 4-pyridylcarbinol and 2-hydroxypyrimidine.

Of these, the nitrogen-containing alicyclic compounds are preferred. Those having a piperidine ring or a morpholine ring are more preferred, and those having a morpholine ring are most preferred.

The alkylene oxide in the present invention may preferably include ethylene oxide, propylene oxide and butylene oxide.

The transition temperature of the thermoreversible thickening polymer used in the present invention can be readily adjusted by controlling the type of alkylene oxides or the addition molar number thereof. For example, in the case of ethylene oxide, the transition temperature becomes higher with an increase in the addition molar number. In the case of propylene oxide or butylene oxide, the transition temperature becomes lower with an increase in the addition molar number. The alkylene oxide may preferably have a molar number of from 1 to 20 mol, and more preferably from 1 to 5 mol.

The vinyl-type carboxylate (a) is an ester of the alkylene oxide addition product with the vinyl-type carboxylate. The vinyl-type carboxylate may preferably include acrylic- or methacrylic acid, maleic acid, vinyl benzoic acid and derivatives of these, and particularly preferably acrylic- or methacrylic acid and acrylic- or methacrylic acid derivatives.

The water-soluble vinyl-type polymer (A) is a polymer of one or more of the ester (a) or a copolymer of one or more of the ester (b) with other vinyl monomer, and may have at least 50% by weight of at least one ester (a) as its constituent unit.

As the above other vinyl-type monomer (b), hydroxyethyl acrylate or methacrylate, monoacrylate or monomethacrylate of polyethylene glycol, acryl- or methacrylamide, N-hydroxymethyl acryl- or methacrylamide, N-vinyl-2-pyrrolidone, acrylic or methacrylic acid, maleic acid or anhydride thereof, styrenesulfonic acid, N,N-dimethylaminoethyl acrylate or methacrylate, N,N-diethylaminopropyl acrylate or methacrylate, methyl acrylate or methacrylate, butyl acrylate or methacrylate, glycidyl acrylate or methacrylate, N-butyl acryl- or methacrylamide, N-cyclohexyl acryl- or methacrylamide, acryl- or methacrylonitrile, styrene, vinyl acetate, vinyl chloride, butadiene, and isoprene are preferred.

Of the monomers constituting the water-soluble vinyl-type polymer (A), the ester (a) causes to change a temperature range of viscosity increase, depending on its compositional ratio. In order to make this temperature range as small as possible, the ester (a) may preferably be in an amount of not less than 50% by weight, and more preferably not less than 70% by weight.

When the above thermoreversible thickening polymer is dissolved in water to form an aqueous solution, its viscosity decreases with an increase in temperature up to a certain transition temperature, but the viscosity steeply increases when exceeding the transition temperature. It also has a feature that the temperature-viscosity relationship has almost no hysteresis. When an aqueous 5% by weight solution thereof is heated at a temperature raising rate of 1° C./min, the temperature gradation of its viscosity is 40 mPa•s/°C. at the transition temperature or above, and hence a sufficient viscosity-increasing effect can be obtained on the recording medium.

The transition temperature, as previously stated, can be readily adjusted to any desired temperatures by changing the type of alkylene oxides or the addition molar number thereof, and hence such a thermoreversible thickening polymer solution can be applied in various recording heads whose temperature rise characteristics change depending on form and recording methods.

Since, however, the transition temperature of the thermoreversible thickening polymer changes depending on the types and amount of additive components such as salts, surface active agents and solvents in inks, it is necessary to use a transition temperature at a composition of ink applied.

In the present invention, the molecular weight and amount of the thermoreversible thickening polymer to be added must be controlled within the tolerance limit (20 mPa•s or below) of ink viscosity. The thermoreversible thickening polymer may preferably have a weight average molecular weight ranging from 1,000 to 1,000,000. If this molecular weight is more than 1,000,000, the thermoreversible thickening polymer may have an excessively long molecular chain to cause a decrease in rate of re-dissolution or come to have a stringiness. Thus, such a molecular weight is not preferable. A relatively low molecular weight range of, e.g., less than 1,000 is also not preferable since the thermoreversible thickening polymer may have a weak viscosity-increasing effect.

The amount of the thermoreversible thickening polymer to be added may be influenced by other additives and solvents, and it is difficult to absolutely define it. When the thermoreversible thickening polymer has a small molecular weight, it has a weak ink viscosity-increasing effect, and must be added in a large amount. When, on the other hand, it has a large molecular weight, it may be added in a small amount to have a sufficient ink viscosity-increasing effect. Accordingly, in usual cases, it may be added in an amount ranging from 0.005 to 10% by weight to obtain preferable results. When it has a molecular weight of near to 1,000 within the above range, it may preferably be added in an amount of from 2 to 10% by weight, and when having a molecular weight close to 1,000,000 within the above range, from 0.005 to 3% by weight.

The present invention is effective also when thermoreversible thickening polymers having different molecular weights are used in the form of a mixture.

The thermoreversible thickening polymer used in the present invention also includes a surface active agent having a cloud point. The surface active agent having a cloud point is a nonionic surface active agent, the aqueous solutions or aqueous suspensions of which increases a viscosity at a certain temperature (clouding point Tc), having a maximum viscosity point Tp, having the properties to cause a decrease in viscosity at a temperature not lower than the maximum viscosity point and exhibits a reversible temperature-viscosity relationship.

In the present invention, as the surface active agent, compounds shown below are preferably usable.

In the first place, preferable is a higher alcohol-ethylene oxide addition product type surface active agent of the formula $$R—0—(CH_2CH_20)_n—H \quad (I)$$

wherein R represents an alkyl group having 8 to 22 carbon atoms, and n represents an integer of 6 to 20.

In the second place, preferable is a propylene glycol-ethylene oxide addition type surface active agents of the formula $$HO—(CH_2CH_2O)_n—(\overset{CH_3}{\overset{|}{C}}HCH_2O)_m—(CH_2CH_2O)_n—H \quad (II)$$

wherein m represents an integer of 20 to 80, and n an integer of 5 to 200.

When the above surface active agent is used in the form of an aqueous solution, its viscosity almost does not change with temperature rise up to a certain cloud point Tc, and the viscosity steeply increases at the cloud point Tc or above. When the temperature is further raised, it reaches a maximum viscosity point Tp, where the viscosity becomes maximum and, when exceeding the temperature Tp, the viscosity increase, and the decrease in viscosity, i.e., the rate of re-dissolution becomes almost equal to the rate of viscosity increase, showing a feature that its temperature-viscosity relationship has almost no hysteresis.

The cloud point can be readily adjusted to any desired temperatures by changing the type of alkylene oxides or the addition molar number thereof, and hence such an aqueous solution can be applied in various recording heads whose temperature rise characteristics change depending on form and recording methods. Since, however, the cloud point thereof may change depending on the types and amount of the thermoreversible thickening polymer used in combination and additive components such as salts, surface active agents and solvents in inks, it is necessary to use a cloud point at a composition of ink applied.

In the present invention, the molecular weight and amount of the surface active agent to be added must be controlled within the tolerance limit (20 mpa•s or below) of the viscosity of the ink used. In the surface active agent of the formula (I), those in which R is an alkyl group of 8 to 22 carbon atoms and n is a molar number of 6 to 20 are preferred. In the surface active agent of the formula (II), those in which the propylene glycol moiety functions as a hydrophobic part, m is a molar number of 20 to 80, and in the hydrophilic part ethylene oxide, n is in the range of from 5 to 200 (10 to 80% by weight of the whole molecule). The cloud point increases with an increase in a proportion of the ethylene oxide in the whole molecules, and hence the cloud point can be arbitrarily set by controlling the ethylene oxide proportion and the propylene oxide proportion.

The amount of the above surface active agent added to the ink may be influenced by other additives and solvents, and it is difficult to absolutely define it. Since it has a relatively small molecular weight, it can be added in an amount set in a wide range, and may preferably be added in an amount ranging from 0.1 to 10% by weight. If added in an amount less than 0.1% by weight, it may weaken the viscosity-increasing effect, and if added in an amount more than 10% by weight, the ink may have too high a viscosity, and also its permeability to paper or the like may become too high to cause feathering, to making color forming performance undesirably lower.

The present invention is well effective also when different surface active agents of any of the formulae (I) and (II) are used in the form of a mixture so long as those having cloud points close to each other are used in combination.

The ink containing the thermoreversible thickening polymer or surface active agent as described above may be adequate when the viscosity is increased to 10 mPa•s or above on the recording medium in order to prevent any bleeding due to viscosity increase. Hence, a sufficient viscosity-increasing effect can be obtained on the recording medium by controlling the viscosity temperature gradient of the ink so as to be 20 mPa•s/°C. or above at the transition temperature or above when the ink is heated at a rate of temperature rise of 1° C./min.

The surface active agent as described above includes the propylene glycol-ethylene oxide addition type surface active agents, and those in which m=35 and n=15 in the formula (II) and the ethylene oxide holds about 40% of the whole molecules are available (Newpole PE-74; trade name, available from Sanyo Chemical Industries, Ltd.), having a cloud point Tc of 55° C.

The thermoreversible thickening polymers, the water-soluble vinyl-type polymer and the surface active agent, as described above may each be used in a single form, or may be used in combination thereof, without any difference in effects. Also, at least one of these may be used. It is preferable to use them in combination.

The coloring matter usable in the ink used in the present invention includes those known in the art, as exemplified by water-soluble dyes such as direct dyes, acid dyes, basic dyes, reactive dyes and food dyes, and insoluble coloring matters such as pigments and disperse dyes.

For example, water-soluble dyes may include; direct dyes such as C.I. Direct Black 17, 19, 22, 32, 38, 51, 62, 71, 108, 146 and 154; C.I. Direct Yellow 12, 24, 26, 44, 86, 87, 98, 100, 130 and 142; C.I. Direct Red 1, 4, 13, 17, 23, 28, 31, 62, 79, 81, 83, 89, 227, 240, 242 and 243; C.I. Direct Blue 6, 22, 25, 71, 78, 86, 90, 106 and 199; C.I. Direct Orange 34, 39, 44, 46 and 60; C.I. Direct Violet 47 and 48; C.I. Direct Brown 109; and C.I. Direct Green 59;

acid dyes such as C.I. Acid Black 2, 7, 24, 26, 31, 52, 63, 112, 118, 168, 172 and 208; C.I. Acid Yellow 11, 17, 23, 25, 29, 42, 49, 61 and 71; C.I. Acid Red 1, 6, 8, 32, 37, 51, 52, 80, 85, 87, 92, 94, 115, 180, 254, 256, 289, 315 and 317; C.I. Acid Blue 9, 22, 40, 59, 93, 102, 104, 113, 117, 120, 167, 229, 234 and 254; C.I. Acid Orange 7 and 19; and C.I. Acid Violet 49;

reactive dyes such as C.I. Reactive Black 1, 5, 8, 13, 14, 23, 31, 34 and 39; C.I. Reactive Yellow 2, 3, 13, 15, 17, 18, 23, 24, 37, 42, 57, 58, 64, 75, 76, 77, 79, 81, 84, 85, 87, 88, 91, 93, 95, 102, 111, 115, 116, 130, 131, 132, 133, 135, 137, 139, 140, 142, 143, 144, 145, 146, 147, 148, 151, 162 and 163; C.I. Reactive Red 3, 13, 16, 21, 22, 23, 24, 29, 31, 33, 35, 45, 49, 55, 63, 85, 106, 109, 111, 112, 113, 114, 118, 126, 128, 130, 131, 141, 151, 170, 171, 174, 176, 177, 183, 184, 186, 187, 188, 190, 193, 194, 195, 196, 200, 201, 202, 204, 206, 218 and 221; C.I. Reactive Blue 2, 3, 5, 8, 10, 13, 14, 15, 18, 19, 21, 25, 27, 28, 38, 39, 40, 41, 49, 52, 63, 71, 72, 74, 75, 77, 78, 79, 89, 100, 101, 104, 105, 119, 122, 147, 158, 160, 162, 166, 169, 170, 171, 172, 173, 174, 176, 179, 184, 190, 191, 194, 195, 198, 204, 211, 216 and 217; C.I. Reactive Orange 5, 7, 11, 12, 13, 15, 16, 35, 45, 46, 56, 62, 70, 72, 74, 82, 84, 87, 91, 92, 93, 95, 97 and 99; C.I. Reactive Violet 1, 4, 5, 6, 22, 24, 33, 36 and 38; C.I. Reactive Green 5, 8, 12, 15, 19 and 23; and C.I. Reactive Brown 2, 7, 8, 9, 11, 16, 17, 18, 21, 24, 26, 31, 32 and 33; and C.I. Basic Black 2; C.I. Basic Red 1, 2, 9, 12, 13, 14 and 27; C.I. Basic Blue 1, 3, 5, 7, 9, 24, 25, 26, 28 and 29; C.I. Basic Violet 7, 14 and 27; and C.I. Food Black 1 and 2. These examples of the coloring matter are particularly preferred for the ink used in the present invention. Coloring matters used in the ink of the present invention are by no means limited to the above coloring matters.

Pigments may also be used since they do not adversely affect the present invention. More specifically, it is possible to use carbon black such as No. 2300, No. 900, MCF 88, No. 33, No. 40, No. 45, No. 52, MA 7, MA 8, #2200B and MA-100, available from Mitsubishi Chemical Corporation; RAVEN 1255 and RAVEN 1066, available from Columbian Carbon Japan Limited; REGAL 330R, REGAL 660R and MOGUL L, available from Cabot Corp.; COLOR BLACK FW 18, PRINTEX 35 and PRINTEX U, available from Degussa Japan Co., Ltd; carbon black whose particle surfaces have been oxidized or treated with plasma; organic pigments such as insoluble azo pigments, azo lake pigments, phthalocyanine pigments, isoindolinone high-grade pigments, quinacridone high-grade pigments, dioxane violet, and perynone or perylene high-grade pigments; and inorganic pigments such as ultramarine blue (laundry blue), prussian blue (iron blue), titanium yellow, and molybdenum red.

As coloring materials grouped into the above pigments, what is called toner pigments, obtained by dyeing a dye to an extender pigment, may also be used as the coloring matter of the present invention.

Such a coloring matter may preferably be used in the ink usually in such a proportion that it holds about 0.1 to 25% by weight based on the total weight of the ink.

As the liquid medium, water and optionally a water-soluble organic solvent may be used. The water-soluble organic solvent may include alkyl alcohols having 1 to 5 carbon atoms, such as methyl alcohol, ethyl alcohol, isopropyl alcohol, n-butyl alcohol, isobutyl alcohol, sec-butyl alcohol, tert-butyl alcohol and n-pentanol, amides such as dimethylformamide and dimethylacetamide, ketones or ketols such as acetone and diacetone alcohol, ethers such as tetrahydrofuran and dioxane, polyalkylene glycols such as polyethylene glycol and polypropylene glycol, alkylene glycols such as ethylene glycol, propylene glycol, butylene glycol, triethylene glycol, hexylene glycol and diethylene glycol, 1,2,6-hexanetriol, thiodiglycol, lower alkyl ethers of polyhydric alcohols, such as ethylene glycol methyl ether, diethylene glycol monomethyl ether and triethylene glycol monomethyl ether, and besides, glycerol, N-methyl-2-pyrrolidone, 1,3-dimethyl-2-imidazolidinone, monoethanolamine, triethanolamine, sulforane, dimethyl sulfoxide, urea, and 1,3-bis(β-hydroxyethyl)urea.

There are no particular limitations on the proportion of any of these water-soluble organic solvent held in the ink. Usually, as a preferable range, it may be used in an amount of from 1 to 80% by weight, and preferably from 2 to 60% by weight, based on the total weight of the ink.

A content of water in the ink depends on the type and composition of the above solvent, and is determined in a wide range. Usually, it may be used in an amount ranging from 10.0 to 98.0% by weight, and preferably from 35.0 to 95.0% by weight, based on the total weight of the ink.

Besides, the ink used in the present invention may optionally also contain additives including dispersants, viscosity modifiers such as polyvinyl alcohol, celluloses and water-soluble resins, surface tension modifiers such as diethanolamine and triethanolamine, viscosity modifiers, pH adjusters, antiseptics, antioxidants, wetting agents, antifungal agents and other surface active agents.

The ink used in the present invention may also preferably have physical properties such as a viscosity at 25° C. of from 1 to 20 mpa•s, a surface tension of 30 mN/m or above and a pH of about 6 to 10.

The ink used in the present invention as described above is effective when used in ink-jet recording. The ink-jet recording process includes a recording process in which a mechanical energy is applied to an ink to eject the ink, and a process in which a heat energy is imparted to an ink to bubble the ink, thereby ejecting the ink. The ink described above is particularly preferable in such recording processes.

Figure 2:
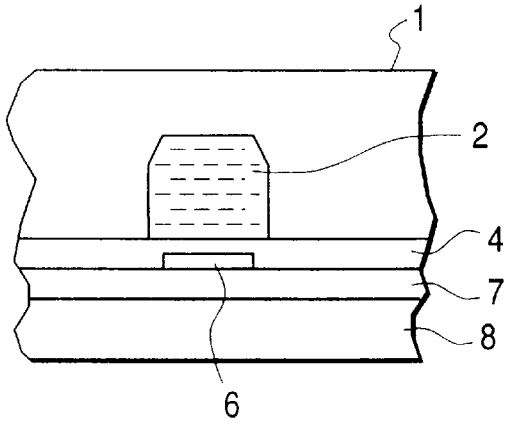
FIG. 2 is a transverse cross section of the head assembly of an ink-jet recording apparatus.
Figure 3:
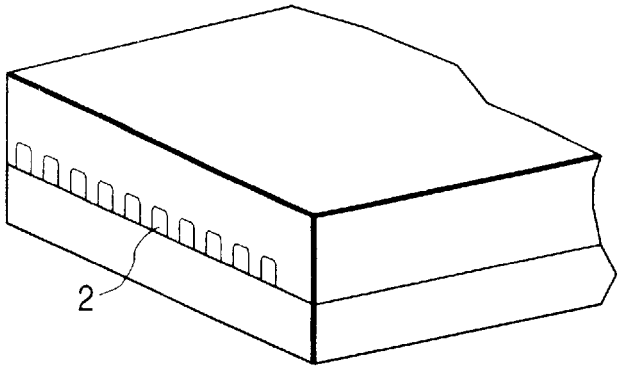
FIG. 3 illustrates an example of a head having a plurality of nozzles, used in an ink-jet recording apparatus.

With regard to the ink-jet recording apparatus, first, examples of the construction of the recording head, which is the main component of the apparatus utilizing heat energy, are shown in FIGS. 1, 2 and 3.

In FIG. 1, a head 1 is formed by bonding a glass, ceramic, silicon or plastic plate or the like provided with an ink channel (a nozzle) 2, to a heating element substrate 3. The heating element substrate 3 is comprised of a protective film 4 formed of silicon oxide, silicon nitride, silicon carbide or the like, electrodes 5 formed of aluminum, gold, an aluminum-copper alloy or the like, a heating resistor layer 6 formed of $HfB_2$, TaN, TaAl or the like, a heat accumulating layer 7 formed of thermally oxidized silicon, aluminum oxide or the like, and a substrate 8 formed of a material having good heat dissipation properties, made of silicon, aluminum, aluminum nitride or the like.

Upon application of pulsewise electric signals to the electrodes 5, heat is abruptly generated at the region denoted by h in the heating element substrate 3 of the head, so that bubbles are generated in the ink coming into contact with the surface of this region. The pressure thus produced thrusts out a meniscus 10 and the ink is ejected from the orifice 11 in the form of minute ink droplets 12 through the nozzle 2 of the head to fly against a recording medium 13.

FIG. 3 schematically illustrates a multi-head comprising the head as shown in FIG. 1 arranged in a large number.

Incidentally, FIG. 1 is a cross-sectional view of the head along its ink channel, and FIG. 2 is a cross-sectional view along the line 2—2 in FIG. 1.

Figure 4:
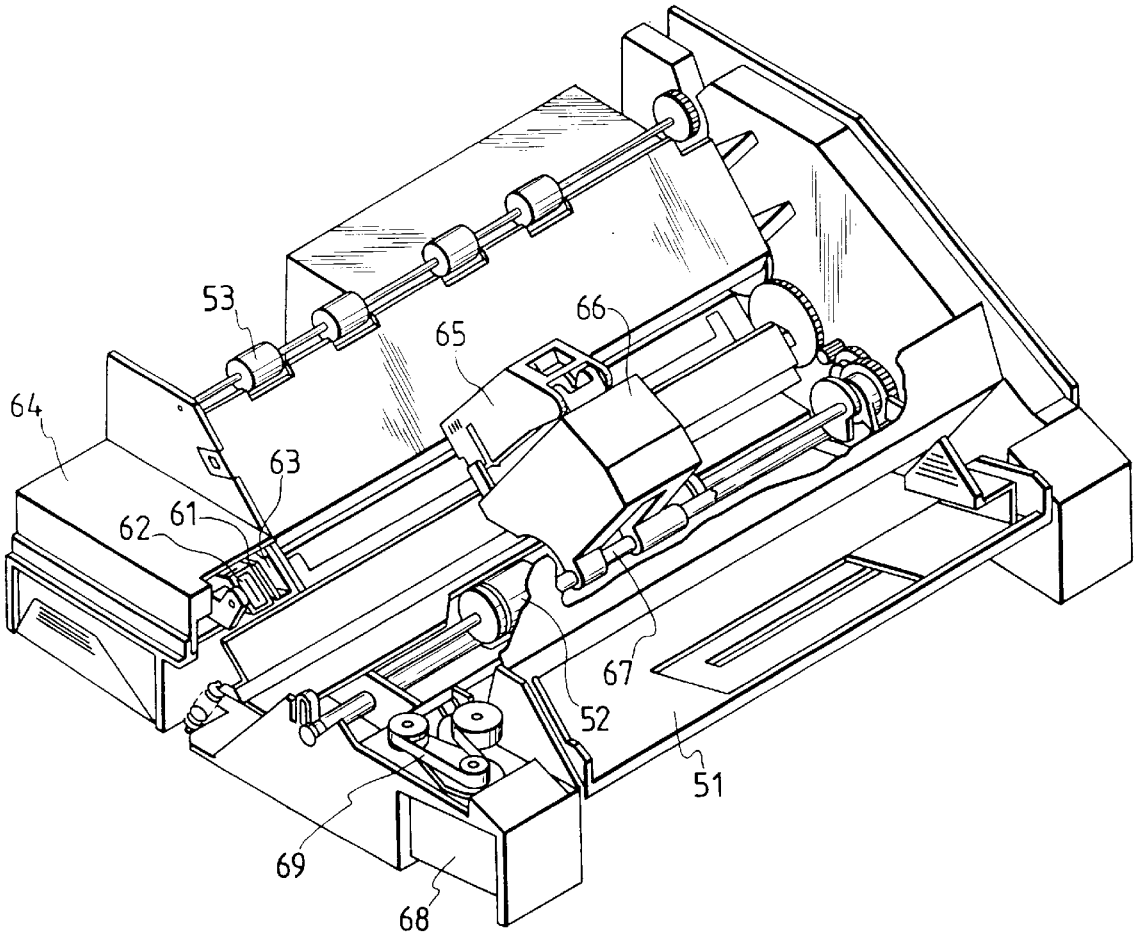
FIG. 4 is a perspective illustration of an example of an ink-jet recording apparatus.

FIG. 4 shows an example of the ink-jet recording apparatus in which such a head has been incorporated.

In FIG. 4, reference numeral 61 denotes a blade serving as a wiping member in the form of a cantilever, one end of which is a stationary end retained by a blade-retaining member. The blade 61 is provided at the position adjacent to the region in which a recording head makes a record. The blade is provided at the position adjacent to the region in which recording is performed by the recording head, and is so constituted that it moves in the direction perpendicular to the movement of the recording head to come in touch with the ejection opening face and performs capping. Reference numeral 63 denotes an ink absorber provided adjoiningly to the blade 61, and, similar to the blade 61, is retained in such a form that it projects to the course through which the recording head is moved. The above blade 61, cap 62 and absorber 63 constitute an ejection restoration assembly 64, where the blade 61 and the absorber 63 remove water, dust and so forth from the ink ejection opening face.

Reference numeral 65 denotes the recording head having an ejection energy generating means and ejects ink to the recording medium set opposingly to the ejection opening face provided with ejection openings, to perform recording. Reference numeral 66 denotes a carriage on which the recording head 65 is mounted so that the recording head 65 can be moved. The carriage 66 is slidably associated with a guide shaft 67. Part of the carriage 66 is connected (not shown) with a belt 69 driven by a motor 68. Thus, the carriage 66 can be moved along the guide 67 and hence the recording head 65 can be moved from a recording region to a region adjacent thereto.

Reference numeral 51 denotes a feeding part from which a recording medium is inserted, and 52, a feed roller driven by a motor (not shown). With such construction, the recording medium is fed to the position opposing to the ejection opening face of the recording head 65, and, with progress of recording, outputted from an output section provided with an output roller 53.

In the above constitution, the cap 62 of the head restoration assembly 64 is receded from the moving course of the recording head 65 when the recording head 65 is returned to its home position after completion of recording, and the blade 61 stands projected to the moving course. As the result, the ejection opening face of the recording head 65 is wiped. When the cap 62 comes into contact with the ejection opening face of the recording head 65 to carry out capping, the cap 62 is moved in such a way that it projects to the moving course of the recording head. When the recording head 65 is moved from its home position to the position at which recording is started, the cap 62 and the blade 61 are at the same position as the position where the ejection opening face is wiped. As the result, the ejection opening face of the recording head 65 of the recording head 65 is wiped also at t he time of this movement.

The above movement of the recording head to its home position is made not only at the time of the completion of recording or restoration of ejection, but also when the recording head is moved between recording regions for the purpose of recording, during which it is moved to the home position adjacent to each recording region at given intervals, where the ejection opening face is wiped in accordance with this movement.

Figure 5:
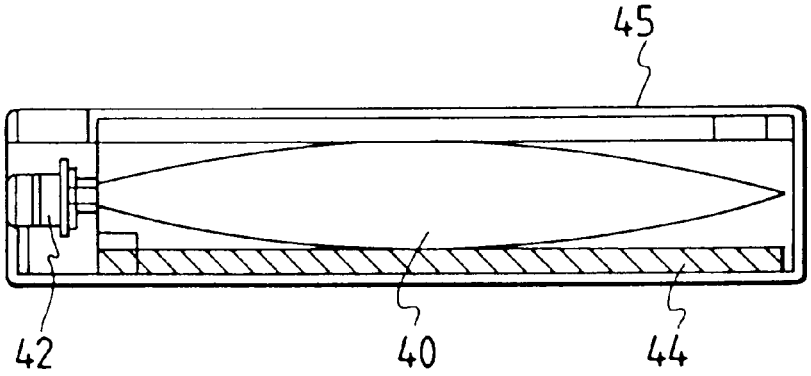
FIG. 5 is a longitudinal cross section showing an example of an ink cartridge.

FIG. 5 is a vertical cross section showing an example of an ink cartridge that has held the ink being fed to the head through an ink-feeding member, e.g., a tube. Here, reference numeral 45 denotes the ink cartridge, and 40 denotes an ink holder, e.g., an ink bag, that has held the feeding ink. The top thereof is provided with a stopper 42 made of rubber. A needle (not shown) may be inserted to this stopper 42 so that the ink in the ink holder 40 can be fed to the head. Reference numeral 44 denotes an ink absorber that receives a waste ink. It is preferable for the ink holder to be formed of a polyolefine, especially polyethylene, at its face coming into contact with ink.

Figure 6:
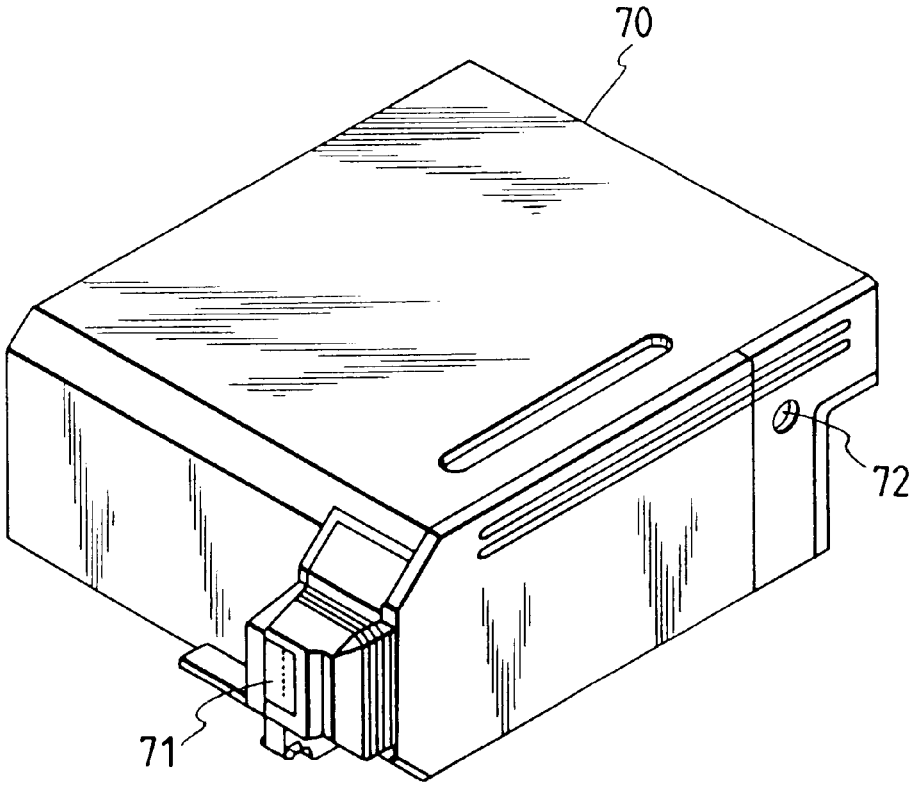
FIG. 6 is a perspective illustration of a recording unit in which an ink-jet recording head and an ink cartridge are combined.

The ink-jet recording apparatus used in the present invention is not limited to the apparatus as described above in which the head and the ink cartridge are separately provided, and a device can also be preferably used in which these are integrally formed as shown in FIG. 6.

In FIG. 6, reference numeral 70 denotes a recording unit, in the interior of which an ink receiving member, e.g., an ink absorber, that has held an ink is received. The recording unit 70 is so constructed that the ink in such an ink absorber is ejected in the form of ink droplets from a head 71 having a plurality of orifices.

As a material for the ink absorber, it is preferable in the present invention to use polyurethane. In place of the ink absorber, the recording unit may be so constructed that the ink receiving member is an ink bag internally provided with a spring or the like. Reference numeral 72 denotes an air path opening through which the interior of the cartridge is made to communicate with the atmosphere. This recording unit 70 can be used in place of the recording head shown in FIG. 4, and is detachably mounted to the carriage 66.

Next, with regard to the form of the second ink-jet recording apparatus utilizing mechanical energy, an On-Demand type ink-jet recording head is available which is provided with a nozzle substrate having a plurality of nozzles, a pressure generating device comprised of a piezoelectric material and a conductive material, provided opposingly to the nozzles, and an ink with which the surrounding of the pressure generating device is filled, and in which the pressure generating device is caused to undergo displacement by an applied voltage to eject minute ink droplets from the nozzles. An example of the construction of the recording head, which is the main component of the apparatus utilizing heat energy, is shown in FIG. 7.

The recording head is constituted of an ink channel 80 communicating with an ink chamber (not shown), an orifice plate 81 for ejecting ink droplets with the desired volume, a vibrating plate 82 that causes a pressure to directly act on ink, a piezoelectric device 83 that is joined to this vibrating plate 82 and is caused to undergo displacement by electric signals, and a substrate 84 for supporting and fixing the piezoelectric device 83, the orifice plate 81, the vibrating plate 82 and so forth.

Figure 7:
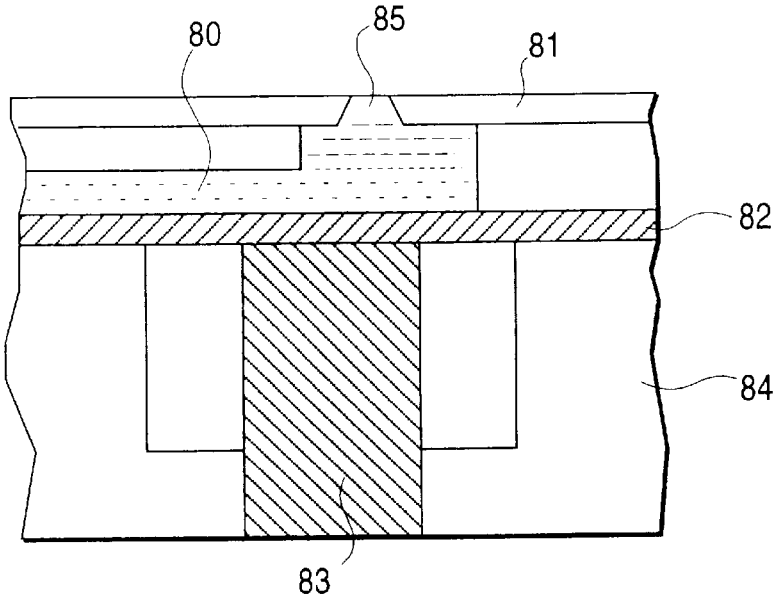
FIG. 7 is a longitudinally sectioned view of an ink-jet recording head that utilizes mechanical energy.

As shown in FIG. 7, the ink channel 80 is formed of a photosensitive resin or the like, and the orifice plate 81 is made of a metal such as stainless steel or nickel, and is provided with an ejection orifice 85 formed by making a hole by electroplating or pressing. The vibrating plate 82 is formed of a metal film of stainless steel, nickel, titanium or the like, or a highly resilient resin. The piezoelectric device 83 is formed of a dielectric material such as barium titanate or PZT (Pb-Zr-Ti).

The recording head constituted as described above operates as follows: It imparts a pulsewise voltage to the piezoelectric device 83 to produce a strain stress, the energy thus produced causes a change in form of the vibrating plate 82 jointed to the piezoelectric device 83, and the ink inside the ink channel 80 is vertically pressed, so that ink droplets (not shown) are ejected from the ejection orifice 85 of the orifice plate 81 to make a record.

Such a recording head is used incorporating it into the same recording apparatus as that shown in FIG. 4. Individual parts of the recording apparatus may operate in the same manner as previously described.

The ink-jet recording process according to the present invention will be described below.

The ink-jet recording process of the present invention is a recording process comprising ejecting an ink from orifices of a recording head onto a recording medium in accordance with recording signals to perform recording, wherein the ink is heated to a temperature corresponding to recording image color signals so that the form and size of impacted dots formed by the ink on the recording medium and the thickness of a colored layer formed by the coloring matter on the recording medium are changed by an elevated temperature of ink to vary an optical density or a color reproduction range, thereby performing recording.

The ink-jet recording process of the present invention includes any one of the following three processes.

(1) Immediately before the ink is ejected from the orifices of the recording head, the ink is heated to a temperature corresponding to recording image color signals so that the form and size of impacted dots formed by the ink on the recording medium and the thickness of a colored layer formed by the coloring matter on the recording medium are changed by an elevated temperature of ink to vary an optical density or a color reproduction range, thereby performing recording; (2) before the ink ejected from the orifices of the recording head arrives at the recording medium to form dots thereon, the recording medium is heated to a temperature corresponding to recording image color signals so that the form and size of impacted dots formed by the ink on the recording medium and the thickness of a colored layer formed by the coloring matter on the recording medium are changed by an elevated temperature of ink to vary an optical density or a color reproduction range, thereby performing recording; and (3) the ink to be ejected from the orifices of the recording head and the recording medium are each heated to a temperature corresponding to recording image color signals so that the form and size of impacted dots formed by the ink on the recording medium and the thickness of a colored layer formed by the coloring matter on the recording medium are changed by an elevated temperature of ink to vary an optical density or a color reproduction range, thereby performing recording.

The heating of the ink in accordance with recording image color signals may preferably be carried out at a temperature not lower than the transition temperature or cloud point of the thermoreversible thickening polymer contained in the ink. Here, the degree of change in the extent and the thickness of the coloring matter layer formed on the recording medium by the ink having been impacted there to form dots thereon becomes greater as the difference between an environmental temperature and the transition temperature or cloud point of the thermoreversible thickening polymer in the ink is greater.

When the ink at the time of recording is heated to a temperature corresponding to recording image color signals, the ink may preferably be heated immediately before it is ejected, in order to prevent nozzles of the recording head from clogging.

For that purpose, the ink temperature in the recording head may preferably be lower than the transition temperature or cloud point of the thermoreversible thickening polymer contained in the ink.

Recording may preferably be performed by applying heat energy or mechanical energy to the ink to eject ink.

The ink-jet recording apparatus of the present invention will be described below.

First, a mechanism with which the ink to be ejected (ejecting ink) is heated to a desired temperature in accordance with recording signals to perform recording will be described with reference to FIG. 8.

Figure 8:
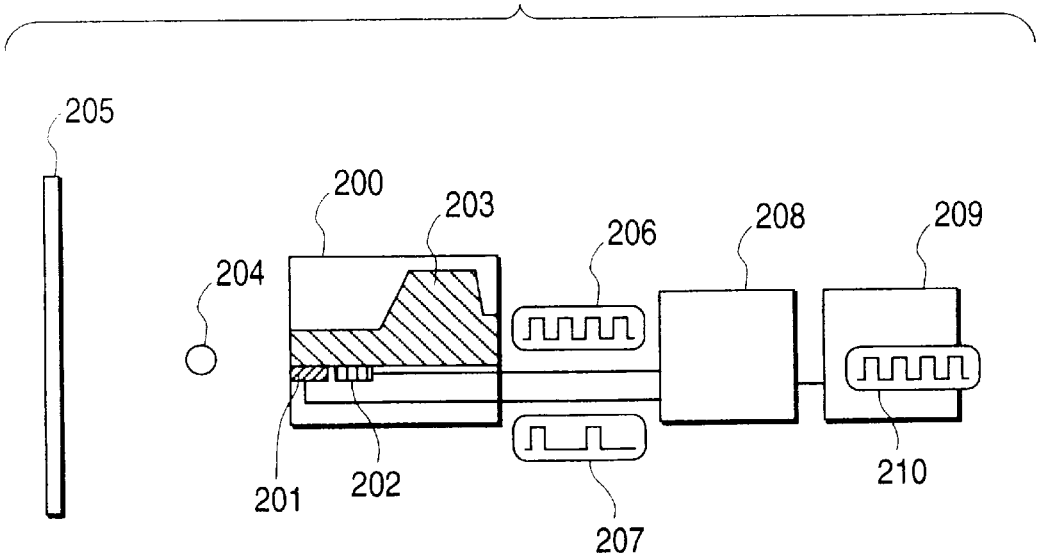
FIG. 8 is a block diagram illustrating an example of a mechanism for heating an ink to be ejected to a desired temperature.

FIG. 8 is a block diagram illustrating an example of a mechanism for heating the ejecting ink to the stated temperature. A recording head 200 has a sensor (not shown) for detecting the temperature of ink in the ink holder provided in the recording head. This temperature sensor is connected with a drive circuit 208 of the recording head 200, and detects temperatures so that the temperature of ink 203 held in the ink holder does not exceed the transition temperature or cloud point of the thermoreversible thickening polymer contained in the ink 203. Meanwhile, the recording head 200 has in its nozzles an ink ejecting portion 202 for ejecting the ink in the form of ink droplets 204 and an ink heating portion 201 for heating the ink immediately before it is ejected in the form of ink droplets 204. The ink ejecting portion 202 and ink heating portion 201 are connected with the same drive circuit 208 of the recording head 200.

Now, once recording signals 210 are inputted to a signal input section 209, the recording signals 210 are separated into an ink ejecting portion drive pulse 206 and an ink heating portion drive pulse 207. The ink heating portion drive pulse 207 is imparted to the ink heating portion 201 prior to the ink ejecting portion drive pulse 206 for driving the ink ejecting portion 202 of the recording head 200 from which the ink is ejected in the form of ink droplets 204, thereby raising a temperature of the ink heating portion 201 to heat to the desired temperature the ink portion to be ejected in the form of ink droplets 204. Immediately after the ink portion to be ejected in the form of ink droplets 204,has reached the desired temperature, the ink ejecting portion drive pulse 206 is imparted to the ink ejecting portion 202, so that the recording operation is started. At this stage, the ink heating portion drive pulse 207 to the ink heating portion 201 is changed so that the temperature of the ink portion to be ejected in the form of ink droplets 204 is changed, whereby the form and size of impacted dots formed by the ink droplets 204 on the recording medium 205 and the thickness of a colored layer formed by the coloring matter on the recording medium can be changed by an elevated temperature of ink to vary an optical density or a color reproduction range, thereby performing recording.

The ink portion the ejected ink droplets 204 had held in the nozzles of the recording head 200 is newly supplied with the ink 203 held in the ink holder, and hence the temperature at the ink portion around the ink heating portion 201 abruptly is lowered. Accordingly, any nozzle clogging due to the viscosity increase of the ink by no means occurs.

The ink heating portion 201 is separated from the ink ejecting portion 202 as so illustrated in FIG. 8, but may be formed in one unit together with the ink ejecting portion 202. There are no particular limitation on structures, when a desired function will be satisfied. Here, the ink heating portion drive pulse 207 is separated from the ink ejecting portion drive pulse 206 as so illustrated in FIG. 8, but may preferably be combined so that the ink ejecting portion drive pulse 206 and the ink heating portion drive pulse 207 are controlled by the drive circuit 208 in such a manner that the latter is imparted to the lead of the former.

Second, a mechanism with which the recording medium is heated to the desired temperature in accordance with recording signals to perform recording will be described with reference to FIG. 9.

Figure 9:
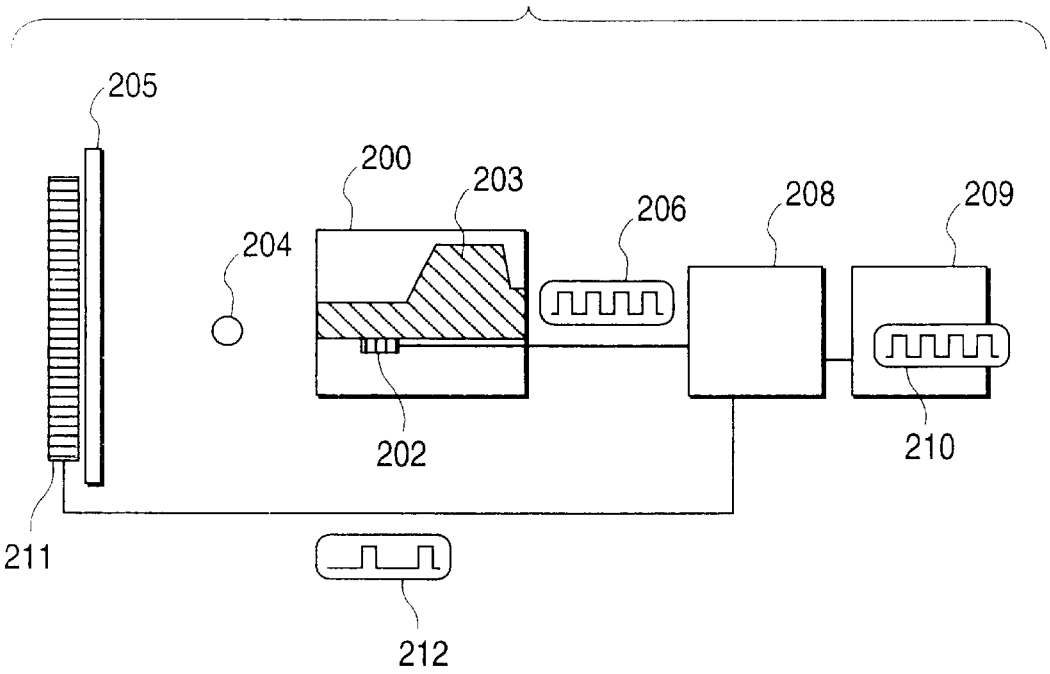
FIG. 9 is a block diagram illustrating an example of a mechanism for heating a recording medium to a desired temperature.

FIG. 9 is a block diagram illustrating an example of a mechanism for heating the recording medium to a desired temperature. A recording head 200 has a sensor (not shown) for detecting the temperature of ink in the ink holder provided in the recording head. This temperature sensor is connected with a drive circuit 208 of the recording head 200, and detects temperatures so that the temperature of ink 203 held in the ink holder does not exceed the transition temperature or cloud point of the thermoreversible thickening polymer contained in the ink 203. Meanwhile, a recording medium heating means 211 provided in contact with, or at a little distance from, a recording medium 205 is connected with the same drive circuit 208 of the recording head 200.

Now, once recording signals 210 are inputted to a signal input section 209, the recording signals 210 are separated into an ink ejecting portion drive pulse 206 and a recording medium heating means drive pulse 212. The recording medium heating means drive pulse 212 is imparted to the recording medium heating means 211 prior to the ink ejecting portion drive pulse 206 for driving the ink ejecting portion 202 of the recording head 200, thereby raising a temperature of the recording medium heating means 211 to heat to the desired temperature the part where the ink droplets 204 will arrive at the recording medium 205. Immediately after the part where the ink droplets 204 will arrive at the recording medium 205 has reached the desired temperature, the ink ejecting portion drive pulse 206 is imparted to the ink ejecting portion 202 so that the ink droplets 204 arrive at that part, whereupon the recording operation is started. At this stage, the recording medium heating means drive pulse 212 to the recording medium heating means 211 is changed so that the temperature of the ink droplets 204 having been impacted at the recording medium 205 to form dots thereon is changed, whereby the form and size of impacted dots formed by the ink droplets 204 on the recording medium 205 and the thickness of a colored layer formed by the coloring matter on the recording medium can be changed by an elevated temperature of ink (ink is heated through the recording medium) to vary an optical density or a color reproduction range thereby performing recording.

After the recording is completed, the recording medium heating means drive pulse 212 fed from the drive circuit 208 to the recording medium heating means 211 is interrupted to lower the temperature of the recording medium 205.

The recording medium heating means 211 may be a means that can control the recording medium to the desired temperature, as exemplified by a thermal head, an infrared heater and a lamp. There are no particular limitations on its shape, size, number and so forth by reason of the mechanism.

Third, a mechanism with which the ink and the recording medium are heated to the desired temperature in accordance with recording signals to perform recording will be described with reference to FIG. 10.

Figure 10:
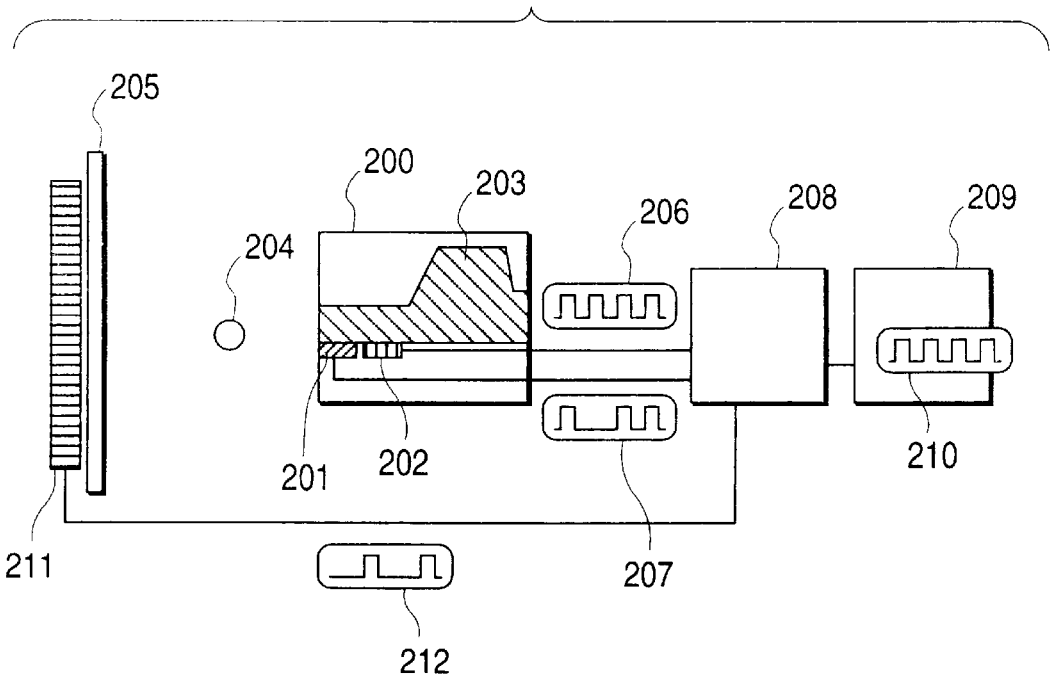
FIG. 10 is a block diagram illustrating an example of a mechanism for heating an ink and a recording medium to a desired temperatures.

FIG. 10 is a block diagram illustrating an example of a mechanism for heating both the ejecting ink and the recording medium to a desired temperature. A recording head 200 has a sensor (not shown) for detecting the temperature of ink in the ink holder provided in the recording head. This temperature sensor is connected with a drive circuit 208 of the recording head 200, and detects temperatures so that the temperature of ink 203 held in the ink holder does not exceed the transition temperature or cloud point of the thermoreversible thickening polymer contained in the ink 203. Meanwhile, the recording head 200 has in its nozzles an ink ejecting portion 202 for ejecting the ink in the form of ink droplets 204 and an ink heating portion 201 for heating the ink immediately before it is ejected in the form of ink droplets 204. The ink ejecting portion 202 and ink heating portion 201 are connected with the same drive circuit 208 of the recording head 200. Also, a recording medium heating means 211 provided in contact with, or at a little distance from, a recording medium 205 is connected with the same drive circuit 208 of the recording head 200.

Now, once recording signals 210 are inputted to a signal input section 209, the recording signals 210 are separated into an ink ejecting portion drive pulse 206, an ink heating portion drive pulse 207 and a recording medium heating means drive pulse 212. The ink heating portion drive pulse 207 and the recording medium heating means drive pulse 212 are imparted to the ink heating portion 201 and the recording medium heating means 211, respectively, prior to the ink ejecting portion drive pulse 206 for driving the ink ejecting portion 202 of the recording head 200 from which the ink is ejected in the form of ink droplets 204. Then, the ink heating portion 201 heats to the desired temperature the ink portion to be ejected in the form of ink droplets 204. Also, the recording medium heating means 211 heats to the desired temperature the part where the ink droplets 204 will arrive at the recording medium 205. Immediately after the ink portion to be ejected in the form of ink droplets 204 and the part where the ink droplets 204 will arrive at the recording medium 205 each have reached the desired temperature, the ink ejecting portion drive pulse 206 is imparted to the ink ejecting portion 202, so that the recording operation is started. At this stage, the ink heating portion drive pulse 207 to the ink heating portion 201 and the recording medium heating means drive pulse 212 to the recording medium heating means 211 are both, or either of them is, changed so that the temperature of the ink portion to be ejected in the form of ink droplets 204 and the temperature of the ink droplets 204 having been impacted at the recording medium 205 to form dots thereon are changed, whereby the form and size of impacted dots formed by the ink droplets 204 on the recording medium 205 and the thickness of a colored layer formed by the coloring matter on the recording medium can be changed by an elevated temperature of ink (ink is heated directly and through the recording medium) to vary an optical density or a color reproduction range, thereby performing recording.

The ink portion being occupied by the ejected ink droplets 204 in the nozzles of the recording head 200 is newly supplied with the ink 203 held in the ink holder, and hence the temperature at the ink portion around the ink heating portion 201 abruptly is lowered. Accordingly, any nozzle clogging due to the viscosity increase of the ink by no means occurs. Also, after the recording is completed, the recording medium heating means drive pulse 212 fed from the drive circuit 208 to the recording medium heating means 211 is interrupted to lower the temperature of the recording medium 205. The temperature of the ejected ink droplets 204 and the temperature at the time when the ink droplets 204 have been impacted at the recording medium 205 to form dots thereon need not necessarily be identical. Any desired combination of these makes it possible better change the control range of the form and size of impacted dots formed on the recording medium 205 and the thickness of a colored layer formed by the coloring matter on the recording medium.

The ink heating portion 201 is separated from the ink ejecting portion 202 as so illustrated in FIG. 10, but may be formed in one unit together with the ink ejecting portion 202. Here, the ink heating portion drive pulse 207 is separated from the ink ejecting portion drive pulse 206 as so illustrated in FIG. 10, but may preferably be combined so that the ink ejecting portion drive pulse 206 and the ink heating portion drive pulse 207 are controlled by the drive circuit 208 in such a manner that the latter is imparted to the lead of the former.

The recording medium heating means 211 may be a means that can control the recording medium to the desired temperature, as exemplified by a thermal head, an infrared heater and a lamp. There are no particular limitations on its shape, size, number and so forth by reason of the mechanism.

The present invention will be described below in greater detail by giving Examples and Comparative Examples. In the tables shown below, ink composition is indicated as % by weight unless particularly noted.

First, the preparation of various inks used in the present invention will be described. As the thermoreversible thickening polymers used in the present Examples, water-soluble vinyl-type polymers are shown in Table 1 and surface active agents having a cloud point are shown in Table 2.

TABLE 1

| Vinyl-type Polymer | | | | |
|---|---|---|---|---|
| Symbol | Compound | Molecular weight | Viscosity of 5% aqueous solution (mpa · s), 30° C. | Transition temp. Ts (° C.) |
| A | Morpholino ethyl methacrylate | 500,000 | 80 | 35 |
| B | 2-(2-morpholino-ethoxy)ethyl methacrylate | 300,000 | 15 | 56 |

TABLE 2

| Surface Active Agent Having Cloud Point | | | |
|---|---|---|---|
| Symbol | Compound | Trade name | Cloud point Tc (° C.) |
| S1 | Higher alcohol-EO adduct n = 7 | Nonipole SOFT DO70 | 47 |
| S2 | Polypropylene glycol-EO adduct n = 15, m = 35 | Newpole PE74 | 55 |

Notes:
(1) EO is the abbreviation for ethylene oxide.
(2) S1 and S2 are both available from Sanyo Chemical Industries, Ltd.

As a procedure for the preparation of the inks used in the present invention, an aqueous thermoreversible thickening polymer (vinyl-type polymer) solution was beforehand prepared by dissolving each thermoreversible thickening polymer in an appropriate concentration (10 to 40%) in ion-exchanged water, and the inks were prepared in the manner as described below.

EXAMPLES 1 TO 4

The respective components as shown in Table 3 were mixed in the following way to prepare inks.

To the aqueous thermoreversible thickening polymer (vinyl-type polymer) solution, ion-exchanged water, solvent, an aqueous dye solution and surface active agent having a cloud point were added in this order with stirring, and each ink composition obtained was adjusted to have a desired concentration. After stirring for 3 hours, the ink composition was filtered with a membrane filter having a pore size of 0.45 $\mu$m. Thus, color (magenta, cyan) inks used in Examples 1 to 4 of the present invention were prepared. As a magenta dye, Dye M1 of the formula (III)

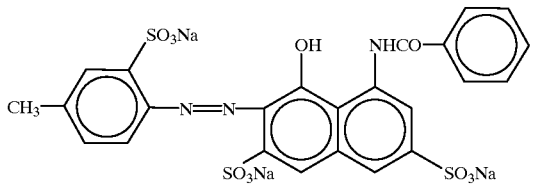

was used.

TABLE 3

| Components | Examples 1 | 2 | 3 | 4 | Comp. Exs. 1 | 2 |
|---|---|---|---|---|---|---|
| Magenta dye, M1 of the formula (III): | 2.5 | — | 2.5 | — | 2.5 | — |
| Cyan dye, C.I. Direct Blue 199: | — | 3.5 | — | 3.5 | — | 3.5 |
| Glycerol: | 5.0 | 5.0 | 5.0 | 5.0 | 5.0 | 5.0 |
| 2,2'-Thiodiethanol: | 5.0 | 5.0 | 5.0 | 5.0 | 5.0 | 5.0 |
| 2-Propanol: | 4.0 | 4.0 | 4.0 | 4.0 | 4.0 | 4.0 |
| Urea: | 5.0 | 5.0 | 5.0 | 5.0 | 5.0 | 5.0 |
| Vinyl-type polymer A: | 0.5 | 0.5 | — | — | — | — |
| Vinyl-type polymer B: | — | — | 0.5 | 0.5 | — | — |
| Surface active agent S1: | 5.0 | 5.0 | — | — | — | — |
| Surface active agent S2: | — | — | 10.0 | 10.0 | — | — |
| Ion-exchanged water: | 73.0 | 72.0 | 68.0 | 67.0 | 78.5 | 77.5 |

COMPARATIVE EXAMPLES 1 AND 2

As comparative examples, inks were prepared in the same manner as in Examples 1 and 2, respectively, except for using neither the thermoreversible thickening polymer (vinyl-type polymer) nor the surface active agent having a cloud point, to obtain corresponding inks of Comparative Examples 1 and 2.

In respect of the above inks of Examples 1 to 4 and the inks of Comparative Examples 1 and 2, performances as inks were evaluated. Evaluation was made in a thermostatic laboratory kept at a temperature of 23° C. and a humidity of 60%.

Evaluation was made by comparing Δchromas, which become a yardstick of an expansion of a color-reproduction on a horizontal plane of a color space, calculated by the equation (X)

$$\Delta chroma = \sqrt{(a^*_{heat})^2 + (b^*_{heat})^2} - \sqrt{(a^*_{room})^2 + (b^*_{room})^2}, \quad (X)$$

wherein $a^*_{room}$ is an a* value at room temperature, $b^*_{room}$ is a b* value at room temperature, $a^*_{heat}$ is an a* value at an elevated temperature and $b^*_{heat}$ is a b* value at an elevated temperature, from L*a*b* values measured according to "CIE 1976 (L*a*b*) Color Space" of CIE (Commission Internationale de l'Echlairage, Paris) using a calorimeter CA-35, manufactured by Murakami Shikisai Kenkyusho. Optical density was also evaluated by measuring reflection density using a Macbeth RD918 densitometer.

As a recording apparatus for the above evaluation, Bubble Jet Printer BJC600, trade name, manufactured by CANON INC., was used. Intended ink was supplied by filling it with the ink container exclusively used for the printer. The printer BJC600 used here is incorporated with a mechanism for heating paper during recording (having the same circuit construction as those shown in FIGS. 8 to 10). This recording apparatus is schematically shown in FIG. 11.

Figure 11:
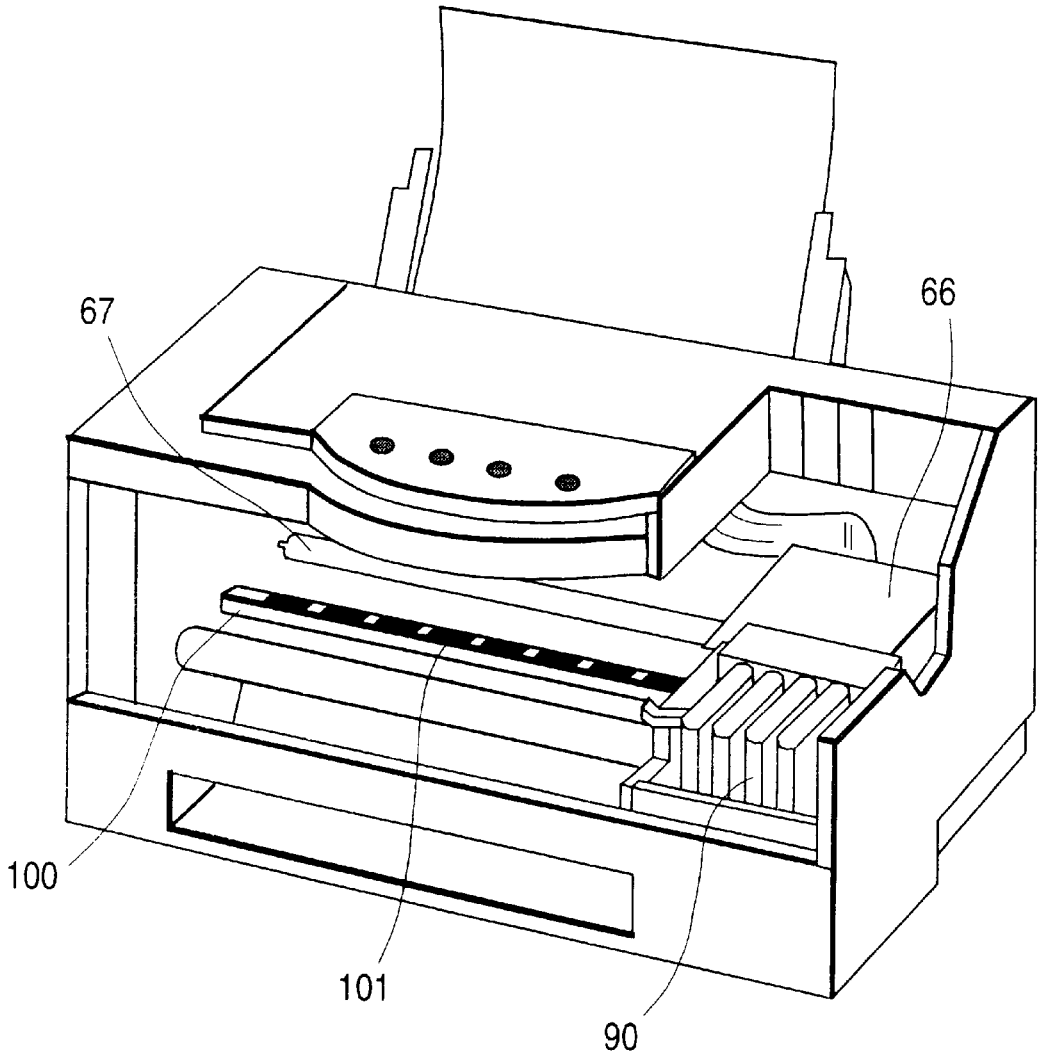
FIG. 11 is a perspective illustration of an example of an ink-jet recording apparatus provided with a heating element.

The recording apparatus shown in FIG. 11 has the basic construction of the recording apparatus shown in FIG. 4, and is provided with a heating element 100. The heating element 100 has ten thermal heads 101, P-8010, manufactured by Nippon Toki K.K., arranged in a A4-width direction, is driven at an applied voltage of 19V and an applied power of 56 W/mm$^2$, and can heat the paper surface in a temperature range of from 30° to 300° C. at an environmental temperature of 23° C. by controlling driving pulse width and driving frequency. Reference numerals 66, 67 and 90 are a carriage, a carriage guide and an ink container equipped on the carriage 67 for feeding inks to ink-jet heads, respectively.

In the evaluation, the following recording processes were basically used.

Recording Process 1:

The recording process in which the ink is directly heated was carried out by adding heating signals for heating only the ink present on the heater, immediately before ejection signals are inputted to the ejection heater in the bubble jet system ink-jet recording head mounted on the BJC600. Heating temperatures were set as no heating (room temperature=23° C.), about 150° C. and about 230° C.

Recording Process 2:

The recording process in which the surface of a recording medium is heated was carried out by adjusting the heating element of the recording apparatus so as to set recording medium surface temperatures as no heating (room temperature=23° C.), about 100° C. and about 190° C. (the surface of the heating element comes in contact with the paper surface)

As paper for the above evaluation, NP-SK PAPER (Lot. No. OKK10) for electrophotography was used.

The results of evaluation are shown below.

The results of evaluation on the recording process according to Examples of the present invention are shown in Tables 4 to 7 and in FIGS. 12 to 15.

Figure 12:
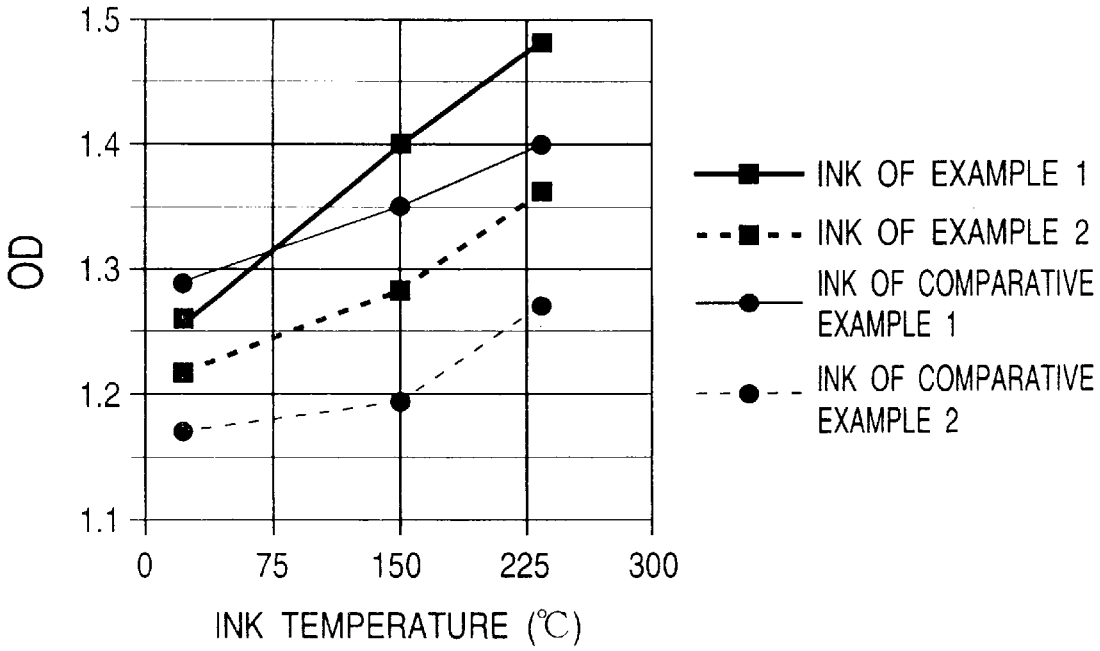
FIGS. 12 and 13 are graphs showing the results of optical density (OD) when recorded by Recording Process 1.

FIG. 12 is a graph showing an optical density, when tested according to Recording Process 1 in which the ink is directly heated, in combination of Example 1 and Example 2 and in combination of Comparative Example 1 and Comparative Example 2.

Figure 13:
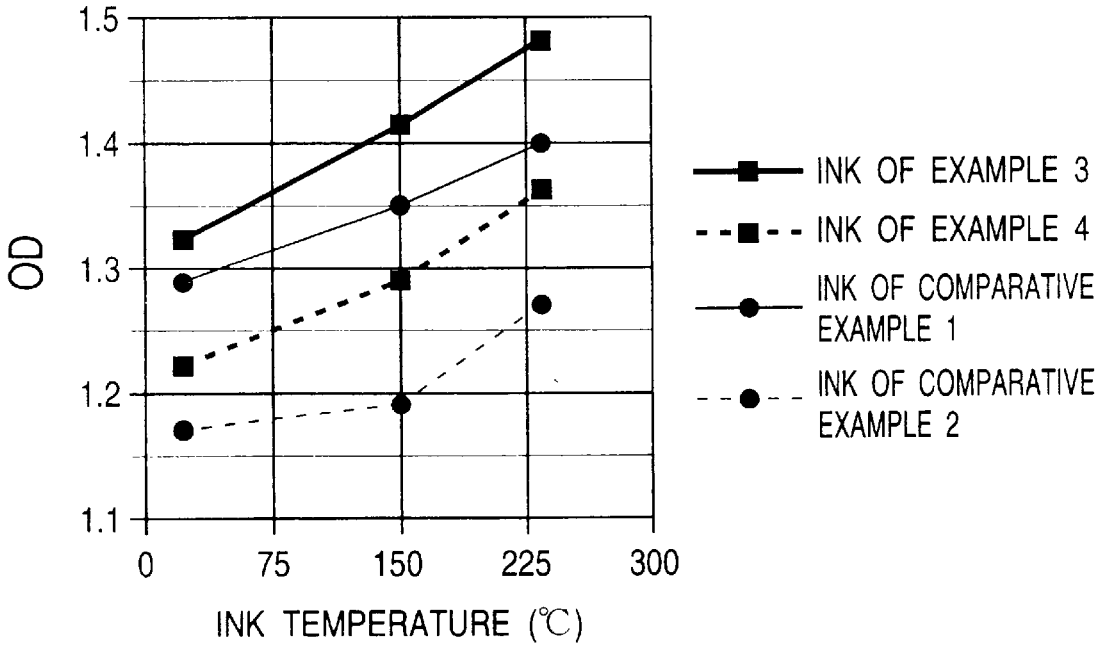

FIG. 13 is a graph showing evaluation results on an optical density, when tested according to Recording Process 1 in which the ink is directly heated, in combination of Example 3 and Example 4 and in combination of Comparative Example 1 and Comparative Example 2.

Figure 14:
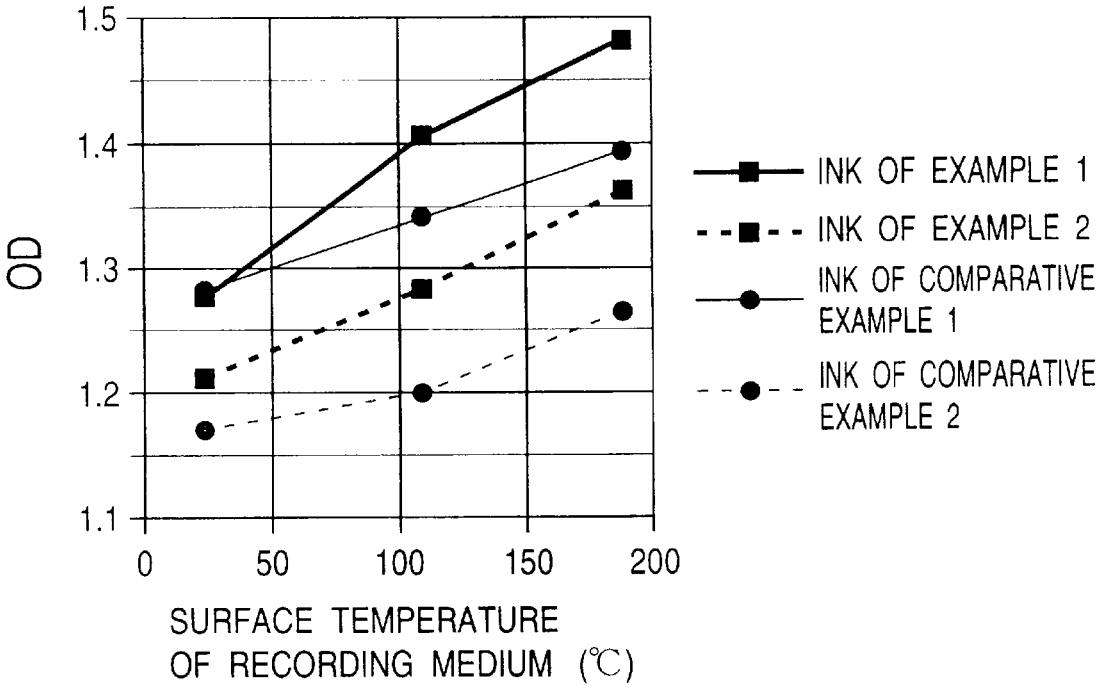
FIGS. 14 and 15 are graphs showing the results of optical density (OD) when recorded by Recording Process 2.

FIG. 14 is a graph showing evaluation results on an optical density, when tested according to Recording Process 2 in which the recording medium surface is heated, in combination of Example 1 and Example 2 and in combination of Comparative Example 1 and Comparative Example 2.

Figure 15:
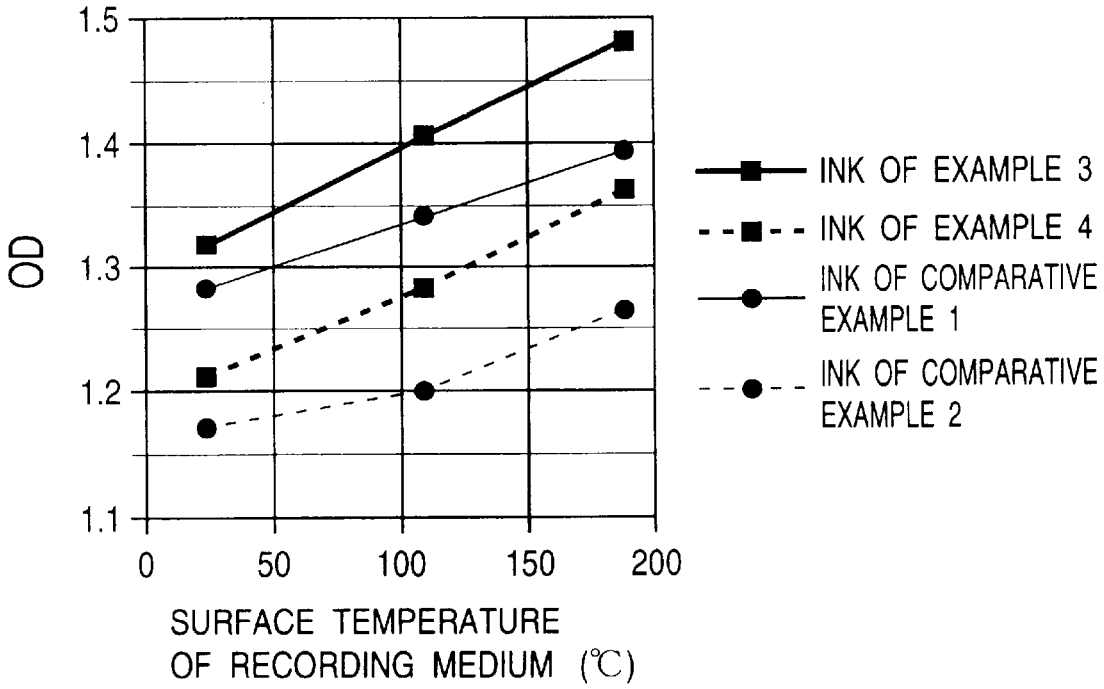

FIG. 15 is a graph showing evaluation results on an optical density, when tested according to Recording Process 2 in which the recording medium surface is heated, in combination of Example 3 and Example 4 and in combination of Comparative Example 1 and Comparative Example 2.

With regard to the results of evaluation when tested in combination of Recording Process 1 and Recording Process 2, substantially the same results as the evaluation results shown in FIGS. 12 to 15 were obtainable.

Tables 4 to 7 show evaluation results of Δchroma. The larger the value of a difference of Δchromas, there is shown that an a*–b* color space is expanded as compared to that at a room temperature (=23° c.).

In Tables 4 to 7, blue colors are evaluated by a procedure as follows: Respective cyan inks of Examples and Comparative Examples are first, as an underlayer, recorded on recording media with Printing Processes 1 and 2, and then respective magenta inks of Examples and Comparative Examples are overlappingly recorded on the recording media with Printing Processes 1 and 2, just on the printed portions of cyan inks with an amount of ink droplets per unit area equal to the amount of the cyan inks on the recording media, to obtain a blue color print. Δchroma values of the blue color prints are measured according to "CIE 1976 (L*a*b*) Color Space" of CIE (Commission Internationale de l'Echlairage Paris) using a colorimeter CA-35, manufactured by Murakami Shikisai Kenkyusho, similar to cyan and magenta color prints.

TABLE 4

Difference between chromas at a room temperature (=23° C.) and at an elevated temperature

| Color of prints | ink | Temp. | Δchroma in combination of Ex. 1, 2 with RP.1 | Δchroma in combination of Comp. Ex. 1, 2 with RP.1 |
|---|---|---|---|---|
| Magenta | Ex. 1 | ca. 150° C. | 1.60 | 0.77 |
| | Comp. Ex. 1 | ca. 230° C. | 3.82 | 1.44 |
| Blue | Mix. 1 | ca. 150° C. | 2.32 | −0.47 |
| | Mix. 2 | ca. 230° C. | 5.13 | −1.00 |
| cyan | Ex. 2 | ca. 150° C. | 0.98 | −0.14 |
| | Comp. Ex. 2 | ca. 230° C. | 1.71 | −0.48 |

Note:
Mix. 1: A mixture of inks of Examples 1 and 2
Mix. 2: A mixture of inks of Comparative Example 1 and 2

TABLE 5

Difference between chromas at a room temperature (=23° C.) and at an elevated temperature

| Color of prints | ink | Temp. | Δchroma in combination of Ex. 3, 4 with RP.1 | Δchroma in combination of Comp. Ex. 1, 2 with RP.1 |
|---|---|---|---|---|
| Magenta | Ex. 3 | ca. 150° C. | 2.02 | 0.81 |
| | Comp. Ex. 1 | ca. 230° C. | 4.49 | 1.45 |
| Blue | Mix. 3 | ca. 150° C. | 2.91 | −0.41 |
| | Mix. 2 | ca. 230° C. | 5.46 | −0.95 |
| cyan | Ex. 4 | ca. 150° C. | 0.70 | −0.13 |
| | Comp. Ex. 2 | ca. 230° C. | 1.38 | −0.46 |

Note :
Mix. 3: A mixture of inks of Examples 3 and 4

TABLE 6

Difference between chromas at a room temperature (=23° C.) and at an elevated temperature

| Color of prints | ink | Temp. | Δchroma in combination of Ex. 1, 2 with RP.1 | Δchroma in combination of Comp. Ex. 1, 2 with RP.1 |
|---|---|---|---|---|
| Magenta | Ex. 1 | ca. 110° C. | 1.77 | 0.75 |
| | Comp. Ex. 1 | ca. 190° C. | 4.07 | 1.41 |
| Blue | Mix. 1 | ca. 110° C. | 2.32 | −0.44 |
| | Mix. 2 | ca. 190° C. | 5.59 | 1.01 |
| cyan | Ex. 2 | ca. 110° C. | 0.99 | 0.13 |
| | Comp. Ex. 2 | ca. 190° C. | 1.91 | −0.48 |

TABLE 7

Difference between chromas at a room temperature (=23° C.) and at an elevated temperature

| Color of prints | ink | Temp. | Δchroma in combination of Ex. 3, 4 with RP.1 | Δchroma in combination of Comp. Ex. 1, 2 with RP.1 |
|---|---|---|---|---|
| Magenta | Ex. 3 | ca. 110° C. | 2.60 | 0.78 |
| | Comp. Ex. 1 | ca. 190° C. | 5.00 | 1.45 |
| Blue | Mix. 3 | ca. 110° C. | 2.91 | −0.50 |
| | Mix. 2 | ca. 190° C. | 6.14 | 0.98 |
| cyan | Ex. 4 | ca. 110° C. | 0.78 | −0.15 |
| | Comp. Ex. 2 | ca. 190° C. | 1.15 | −0.50 |

Note:
Ex. means Example and Comp. Ex. means Comparative Example.
RP.1 and RP.2 mean Recording Process 1 and Recording process 2, respectively.

As described above, according to the present invention, using the ink (water-based ink) containing at least one thermoreversible thickening polymer which gels thermoreversibly upon sensing temperature at its transition temperature or cloud point or above, the ink ejected from orifices of a recording head is heated to a temperature not lower than the transition temperature or cloud point of the ink in accordance with recording image color signals so that the form and size of impacted dots formed by the ink on the recording medium and the thickness of a colored layer formed by the coloring matter on the recording medium are changed by an elevated temperature of ink to vary an optical density or a color reproduction range, thereby performing recording. Thus, an ink-jet recording process and an ink-jet recording apparatus can be provided in which the optical density and color reproduction range are changed to greatly expand the a*–b* color space and the color forming performance and color reproducibility are improved.

In particular, in the present invention, good results can be obtained on the high coloring property, the prevention of feathering and the prevention of color-mix bleeding when applied in color recording on plain paper for office work, such as paper used in electrophotography.

To state additionally, the ink used in the present invention changes in state only in accordance with the temperature change, and hence is useful since it is not affected by the surface pH and irregularities of recording media even when various recording media other than plain paper, e.g., transparency films, cloths and metal sheets are used.

What is claimed is:

1. A process for improving quality of a color image on a recording medium recorded by an ink-jet recording method comprising the steps of ejecting an ink from an ink-jet nozzle of an ink-jet printer; and attaching the ink ejected from the ink-jet nozzle to form an ink dot on a recording medium, the ink containing a polymer having a transition temperature at which the polymer gels, a coloring matter and a liquid medium, and the ink having a viscosity that increases when the ink's temperature exceeds the transition temperature, the process comprising the steps of:

i) maintaining the ink ejected from the ink-jet nozzle for a first ink dot at a first temperature below the transition temperature; and ii) applying heat to the ink immediately before ejection from the ink-jet nozzle for a second ink dot so that the temperature of the ink ejected from the nozzle is at a second temperature, which exceeds the transition temperature, wherein the second temperature is set so that the first ink dot and the second ink dot are different from each other in hue.

2. A process for improving quality of a color image on a recording medium recorded by an ink-jet recording method, the ink-jet recording method comprising the steps of ejecting an ink from an ink-jet nozzle of an ink-jet printer; and attaching the ink ejected from the ink-jet nozzle to form an ink dot on a recording medium, the ink containing a polymer having a transition temperature at which the polymer gels, a coloring matter and a liquid medium, and the ink having a viscosity that increases when the ink's temperature exceeds the transition temperature, the process comprising the steps of:

i) applying a first heat to the ink immediately before ejection from the ink-jet nozzle for a first ink dot so that the temperature of the ink ejected from the nozzle exceeds the transition temperature; and ii) applying a second heat to the ink immediately before ejection from the ink-jet nozzle for a second ink dot so that the temperature of the ink ejected from the nozzle is at a second temperature, which exceeds the transition temperature, wherein the first heat and the second heat are different from each other so that the first ink dot and the second ink dot on the recording medium are different from each other in hue.

3. A process for improving quality of a color image on a recording medium recorded by an ink-jet recording method comprising the steps of ejecting an ink from an ink-jet nozzle of an ink-jet printer; and attaching the ink ejected from the ink-jet nozzle to form an ink dot on a recording medium, the ink containing a polymer having a transition temperature at which the polymer gels, a coloring matter and a liquid medium, and the ink having a viscosity that increases when the ink's temperature exceeds the transition temperature, the process comprising the steps of:

i) maintaining a first position of the recording medium where a first ink dot is formed at a first temperature, and ii) heating a second position of the recording medium where a second ink dot is formed to a second temperature, wherein the first temperature is below the transition temperature and the second temperature is above the transition temperature, and the second temperature is set so that the first ink dot and the second ink dot are different from each other in hue.

4. A process for improving quality of a color image on a recording medium recorded by an ink-jet recording method comprising the steps of ejecting an ink from an ink-jet nozzle of an ink-jet printer; and attaching the ink ejected from the ink-jet nozzle to form an ink dot on a recording medium, the ink containing a polymer having a transition temperature at which the polymer gels, a coloring matter and a liquid medium, and the ink having a viscosity that increases when the ink's temperature exceeds the transition temperature, the process comprising the steps of:

i) heating a first position of the recording medium where a first ink dot is formed to a first temperature, and ii) heating a second position of the recording medium where a second ink dot is formed to a second temperature, wherein the first temperature and the second temperature are above the transition temperature, and the first temperature and the second temperature are set so that the first ink dot and the second ink dot are different from each other in hue.

5. A process for improving quality of a color image on a recording medium recorded by an ink-jet recording method comprising the steps of ejecting an ink from an ink-jet nozzle of an ink-jet printer; and attaching the ink ejected from the ink-jet nozzle to form an ink dot on a recording medium, the ink containing a polymer having a transition temperature at which the polymer gels, a coloring matter and a liquid medium, and the ink having a viscosity that increases when the ink's temperature exceeds a transition temperature, the process comprising the steps of:

i) maintaining the ink ejected from the ink-jet nozzle for a first ink dot at a first temperature below the transition temperature, ii) applying heat to the ink immediately before ejection from the ink-jet nozzle for a second ink dot so that the temperature of the ink ejected from the nozzle is at a second temperature, which exceeds the transition temperature, iii) maintaining a first position of the recording medium where the first ink dot is formed at a third temperature, and iv) heating a second position of the recording medium where the second ink dot is formed to a fourth temperature, wherein a combination of the first and the third temperatures and a combination of the second and the fourth temperatures are set so that the first ink dot and the second ink dot are different from each other in hue.

6. A process for improving quality of a color image on a recording medium recorded by an ink-jet recording method comprising the steps of ejecting an ink from an ink-jet nozzle of an ink-jet printer; and attaching the ink ejected from the ink-jet nozzle to form an ink dot on a recording medium, the ink containing a polymer having a transition temperature at which the polymer gels, a coloring matter and a liquid medium, and the ink having a viscosity that increases when the ink's temperature exceeds the transition temperature, the process comprising the steps of:

i) applying a first heat to the ink immediately before ejection from the ink-jet nozzle for a first ink dot so that the temperature of the ink ejected from the nozzle exceeds the transition temperature, ii) applying a second heat to the ink immediately before ejection from the ink-jet nozzle for a second ink dot so that the temperature of the ink ejected from the nozzle is at a second temperature, which exceeds the transition temperature, iii) maintaining a first position of the recording medium where the first ink dot is formed at a third temperature, and iv) heating a second position of the recording medium where the second ink dot is formed to a fourth temperature, wherein a combination of the first and the third temperatures and a combination of the second and the fourth temperatures are set so that the first ink dot and the second ink dot are different from each other in hue.

7. A process for improving quality of a color image on a recording medium recorded by an ink-jet recording method comprising the steps of ejecting an ink from an ink-jet nozzle of an ink-jet printer; and attaching the ink ejected from the ink-jet nozzle to form an ink dot on a recording medium, the ink containing a polymer having a transition temperature at which the polymer gels, a coloring matter and a liquid medium, and the ink having a viscosity that increases when the ink's temperature exceeds the transition temperature, the process comprising the steps of:

i) maintaining the ink ejected from the ink-jet nozzle for a first ink dot at a first temperature below the transition temperature, ii) applying heat to the ink immediately before ejection from the ink-jet nozzle for a second ink dot so that the temperature of the ink ejected from the nozzle is at a second temperature, which exceeds the transition temperature, iii) heating a first position of the recording medium where the first ink dot is formed to a third temperature, and iv) heating a second position of the recording medium where the second ink dot is formed to a fourth temperature, wherein a combination of the first and the third temperatures and a combination of the second and the fourth temperatures are set so that the first ink dot and the second ink dot are different from each other in hue.

8. A process for improving quality of a color image on a recording medium recorded by an ink-jet recording method comprising the steps of ejecting an ink from an ink-jet nozzle of an ink-jet printer; and attaching the ink ejected from the ink-jet nozzle to form an ink dot on a recording medium, the ink containing a polymer having a transition temperature at which the polymer gels, a coloring matter and a liquid medium, and the ink having a viscosity that increases when the ink's temperature exceeds the transition temperature, the process comprising the steps of:

i) applying a first heat to the ink immediately before ejection from the ink-jet nozzle for a first ink dot so that the temperature of the ink ejected from the nozzle exceeds the transition temperature, ii) applying a second heat to the ink immediately before ejection from the ink-jet nozzle for a second ink dot so that the temperature of the ink ejected from the nozzle is at a second temperature, which exceeds the transition temperature, iii) heating a first position of the recording medium where the first ink dot is formed to a third temperature, and iv) heating a second position of the recording medium where the second ink dot is formed to a fourth temperature, wherein a combination of the first and the third temperatures and a combination of the second and the fourth temperatures are set so that the first ink dot and the second ink dot are different from each other in hue.

9. The process according to any one of claims 1 to 8, wherein said polymer is a water-soluble thermoreversible thickening polymer.

10. The process according to any one of claims 1 to 8, wherein said polymer is a water-soluble vinyl polymer containing as a constituent unit not less than 50% by weight of a vinyl carboxylate of an addition product of alkylene oxide with an active hydrogen-containing compound having a nitrogen-containing ring.

11. The process according to claim 9, wherein the water-soluble thermoreversible thickening polymer is a nonionic surface active agent having a cloud point.

12. The process according to any one of claims 1 to 8, wherein the step for ejecting the ink from the ink-jet nozzle of an ink-jet printer is conducted by applying heat energy to the ink.

13. The process according to any one of the claims 1 to 8, wherein the step for ejecting the ink from the ink-jet nozzle of an ink-jet printer is conducted by applying mechanical energy to the ink.

14. An ink-jet recording apparatus comprising an ink-jet head provided with an ink-jet nozzle, having a tip, for ejecting an ink containing a polymer having a transition temperature at which the polymer gels, a coloring matter and a liquid medium, the ink having a viscosity that increases when the ink's temperature exceeds the transition temperature, wherein the apparatus further comprises a heater provided at the tip of the nozzle and a driving circuit which divides a recording signal into a first pulse for functioning an ink ejecting means adjacent to the heater and a second pulse for functioning the heater, and which applies the first pulse to the ink ejecting means and the second pulse to the heater, wherein the second pulse is applied to the heater before applying the first pulse to the ink ejecting means.

15. The ink-jet recording apparatus according to claim 14, further comprising an ink tank containing the ink.

16. The ink-jet recording apparatus according to claim 14, wherein the first pulse is applied to the ink ejecting means when heat is applied to ink at the tip of the nozzle so as to gel the polymer in the ejected ink.

17. The ink-jet recording apparatus according to claim 14, wherein the second pulse is changed corresponding to recording image color signals so as to change the temperature of the ink ejected from the nozzle.

18. An ink-jet recording apparatus comprising an ink-jet head provided with an ink-jet nozzle for ejecting an ink onto a recording medium, said ink containing a polymer having a transition temperature at which the polymer gels, a coloring matter and a liquid medium, the ink having a viscosity that increases when the ink's temperature exceeds the transition temperature, wherein the apparatus further comprises a heater disposed for heating the recording medium and a driving circuit which divides a recording signal into a first pulse for functioning an ink ejecting means disposed in the nozzle and a second pulse for functioning the heater, and which applies the first pulse to the ink ejecting means and the second pulse to the heater, wherein the second pulse is applied to the heater in order to heat a certain position of the recording medium where an ink ejected from the nozzle is attached before applying the first pulse to the ink ejecting means.

19. The ink-jet recording apparatus according to claim 18, further comprising an ink tank containing the ink.

20. The ink-jet recording apparatus according to claim 18, wherein the first pulse is applied to the ink ejecting means when the position is heated so that the attached ink is gelled on the recording medium.

21. The ink-jet recording apparatus according to claim 18, wherein the second pulse is changed corresponding to recording image color signals so as to change the temperature of the position of the recording medium.

22. An ink-jet recording apparatus comprising an ink-jet head provided with an ink-jet nozzle, having a tip, for ejecting an ink onto a recording medium, said ink containing a polymer having a transition temperature at which the polymer gels, a coloring matter and a liquid medium, the ink having a viscosity that increases when the ink's temperature exceeds the transition temperature, wherein the apparatus further comprises a first heater provided at the tip of the nozzle, a second heater in the vicinity of a recording medium and a driving circuit that divides a recording signal into a first pulse for functioning an ink ejecting means disposed in the nozzle and a second pulse for functioning the first and the second heaters, and that applies the first pulse to the ink ejecting means and the second pulse to the first and the second heaters, wherein the second pulse is applied to the first and the second heaters before applying the first pulse to the ink ejecting means.

23. The ink-jet recording apparatus according to claim 22, further comprising an ink tank containing the ink.

24. The ink-jet recording apparatus according to claim 22, wherein the first pulse is applied to the ink ejecting means when the heat is applied to the ink at the tip of the nozzle so as to gel the polymer in the ejected ink, and a position on the recording medium is heated so that the ink that is applied to the position is gelled on the recording medium.

25. The ink-jet recording apparatus according to claim 22, wherein the second pulse is changed corresponding to recording image color signals so as to change the temperature of the ink ejected from the nozzle and the temperature of a position on the recording medium.

* * * * *

UNITED STATES PATENT AND TRADEMARK OFFICE

CERTIFICATE OF CORRECTION

PATENT NO. : 5,969,740

DATED : October 19, 1999

INVENTOR(S) : HIROYUKI MAEDA, ET AL.

It is certified that error appears in the above-identified patent and that said Letters Patent is hereby corrected as shown below:

COLUMN 1:

Line 48, "technique" should read --techniques--.
Line 62, "information" should read --information,--.

COLUMN 2:

Line 32, "temperature" should read --temperatures--.

COLUMN 3:

Line 5, "to a" should read --to--.
Line 31, "image" should read --images--.

COLUMN 5:

Line 1, "2-methylpyrroridine" should read --2-methylpyrrolidine--.

COLUMN 6:

Line 56, "increases" should read --increase--.

UNITED STATES PATENT AND TRADEMARK OFFICE

CERTIFICATE OF CORRECTION

PATENT NO. : 5,969,740

DATED : October 19, 1999

INVENTOR(S) : HIROYUKI MAEDA, ET AL.

It is certified that error appears in the above-identified patent and that said Letters Patent is hereby corrected as shown below:

COLUMN 7:

Line 5, "agents" should read --agent--.
Line 61, "high to" should read --high and--.
Line 62, "to making" should read --thus making--.

COLUMN 8:

Line 15, "are" should read --that are--.
Line 29, "include;" should read --include:--.

COLUMN 9:

Line 48, "solvent" should read --solvents--.

COLUMN 11:

Line 22, "of the recording head 65" (first occurrence) should be deleted.
Line 23, "t he" should read --the--.

COLUMN 12:

Line 36, "used" should read --used by--.

UNITED STATES PATENT AND TRADEMARK OFFICE

CERTIFICATE OF CORRECTION

PATENT NO. : 5,969,740

DATED : October 19, 1999

INVENTOR(S) : HIROYUKI MAEDA, ET AL.

It is certified that error appears in the above-identified patent and that said Letters Patent is hereby corrected as shown below:

COLUMN 14:

Line 2, "204,has" should read --204 has--.
Line 24, "limitation" should read --limitations--.

COLUMN 16:

Line 35, "better" should read --to better--.

COLUMN 17:

TABLE 1, Line 8, "(mpa·s)," should read --(mPa·s),--.

COLUMN 18:

Line 50, "l'Echlairage," should read --l'Eclairage,-- and "calorimeter" should read --colorimeter--.

COLUMN 19:

Line 25, "surface)" should read --surface).--.

UNITED STATES PATENT AND TRADEMARK OFFICE

CERTIFICATE OF CORRECTION

PATENT NO. : 5,969,740

DATED : October 19, 1999

INVENTOR(S) : HIROYUKI MAEDA, ET AL.

It is certified that error appears in the above-identified patent and that said Letters Patent is hereby corrected as shown below:

COLUMN 20:

Line 7, "l'Echlairage" should read --l'Eclairage,--.
TABLE 4, Line 32, "Example" should read --Examples--.
TABLE 6, Line 59, "RP.1" (both occurrences) should read --RP.2--.

COLUMN 21:

TABLE 7, Line 9, "RP.1" (both occurrences) should read --RP.2--.

COLUMN 26:

Line 21, "a recording" should read --the recording--.

Signed and Sealed this

Twenty-fourth Day of October, 2000

*Attest:*

Q. TODD DICKINSON

*Attesting Officer*

*Director of Patents and Trademarks*